US005784039A

United States Patent [19]

Yasui et al.

[11] Patent Number: 5,784,039

[45] Date of Patent: Jul. 21, 1998

[54] LIQUID CRYSTAL DISPLAY AC-DRIVE METHOD AND LIQUID CRYSTAL DISPLAY USING THE SAME

[75] Inventors: Masaru Yasui; Takeo Kamiya, both of Kobe; Masanori Hosomichi, Akashi, all of Japan

[73] Assignee: Hosiden Corporation, Osaka, Japan

[21] Appl. No.: 387,915

[22] PCT Filed: Jun. 21, 1994

[86] PCT No.: PCT/JP94/00987

§ 371 Date: Feb. 22, 1995

§ 102(e) Date: Feb. 22, 1995

[87] PCT Pub. No.: WO95/00944

PCT Pub. Date: Jan. 5, 1995

[30] Foreign Application Priority Data

| | | | |
|---|---|---|---|
| Jun. 25, 1993 | [JP] | Japan | 5-155587 |
| Sep. 22, 1993 | [JP] | Japan | 5-236282 |
| May 23, 1994 | [JP] | Japan | 6-108108 |

[51] Int. Cl.[6] ..... G09G 3/36

[52] U.S. Cl. ..... 345/89; 345/90

[58] Field of Search ..... 345/76, 92, 206, 345/89, 87, 84, 94, 90; 315/169.3; 359/59; 349/33, 34, 41, 42, 48, 43

[56] References Cited

U.S. PATENT DOCUMENTS

| | | | |
|---|---|---|---|
| 4,393,380 | 7/1983 | Hosokawa et al. | 345/90 |
| 4,963,860 | 10/1990 | Stewart | 345/206 |
| 5,151,805 | 9/1992 | Takeda et al. | 345/94 |
| 5,296,847 | 3/1994 | Takeda et al. | 345/92 |
| 5,302,966 | 4/1994 | Stewart | 345/76 |
| 5,438,241 | 8/1995 | Zavracky et al. | 315/169.3 |
| 5,506,598 | 4/1996 | Shimada et al. | 345/92 |
| 5,515,187 | 5/1996 | Nakamura et al. | 359/59 |

FOREIGN PATENT DOCUMENTS

| | | |
|---|---|---|
| 0 373 565 | 6/1990 | European Pat. Off. . |
| 4-367821 | 12/1992 | Japan . |

*Primary Examiner*—Kee M. Tung
*Assistant Examiner*—John Suraci
*Attorney, Agent, or Firm*—Pollock, Vande Sande & Priddy

[57] ABSTRACT

A gray-scale level signal $V_a$, which is applied to each pixel on a selected gate bus, is added, with its polarity inverted every frame period, to the first and second source bias voltages $V_{S+}$ and $V_{S-}$ which are generated alternately every frame period, and the resulting voltages are each provided as a source voltage $V_S$ to respective source buses. On the other hand, a gate voltage $V_G$, which is applied to each gate bus, includes a period of a high-level gate pulse which turns ON a thin film transistor during about one horizontal scanning period H in each frame period, a gate bias period during which either one of first and second gate bias voltages, which alternate every frame period, immediately precedes the rise of the gate pulse, and a low-level period except these periods. The gate voltage is applied to the respective gate buses so that the gate pulses provided thereto are sequentially displaced one horizontal scanning period apart. The gate bias period of an i-th row has a span from the time of the rise of the gate pulse to time instant preceding the fall of the gate pulse of the immediately preceding (i-1)th row. By this, the first and second gate bias voltages $V_{x1}$ and $V_{x2}$, which are provided to the i-th row, are alternately added to the gate voltage in positive and negative write periods in AC-wise driving of the pixels on the (i-1)th row, reducing flicker in the liquid crystal display.

13 Claims, 10 Drawing Sheets

$-t_0 < t < t_1$ $t_1 < t < t_2$

LIQUID CRYSTAL DISPLAY AC-DRIVE METHOD AND LIQUID CRYSTAL DISPLAY USING THE SAME

TECHNICAL FIELD

The present invention relates to an AC-drive method for an active matrix liquid crystal display and, more particularly, to an AC-drive method which is intended to lessen display flicker and reduce power consumption by combining a bias voltage with a display drive voltage.

The display image quality by the active matrix liquid crystal display (hereinafter referred to as AMLCD) has been drastically improved in recent years. The prior art device has, however, a problem of flicker and a problem that a fixed image is printed immediately after being displayed; various solutions to these problems have been reported. In view of its use such as a liquid crystal TV or the like, it is desirable that the AMLCD be driven with as low power consumption as possible.

Solutions to the flicker problem are disclosed in Japanese Pat. Laid-Open Gazette Nos. 29893/86 and 59493/86. The methods proposed therein, however, do not compensate for a DC voltage which is caused by the dielectric anisotropy of the liquid crystal material used and a parasitic capacitance in the AMLCD itself, and hence do not reduce the flicker for each display pixel but merely lessen apparent flicker all over the display screen.

A method for reducing the power consumption of the source driver is proposed in Japanese Pat. Laid-Open Gazette No. 116923/87, for instance, but the proposed method does not compensate for the DC voltage caused by the dielectric anisotropy either.

Drive method which compensate for the DC voltage attributable to the dielectric anisotropy are set forth in "Compensation of the Display Electrode Voltage Distortion" (Japan Display '86, p. 191–195; this will hereinafter be referred to as literature 1) and "COMPENSATIVE ADDRESSING FOR SWITCHING DISTORTION IN A-SI TFTLCD" (Euro Display '87, p. 107–110; this will hereinafter be referred to as literature 2).

Literature 1 proposes a method which compensates for the DC voltage by changing the amplitude of an image signal voltage between positive and negative sides of its amplitude center. This method is defective in that the positive-negative amplitude ratio needs to be changed in accordance with the magnitude of the image signal. Literature 2 proposes a method which applies a correcting pulse via a capacitance provided in an adjacent gate line; the above-mentioned DC voltage is not generated in principle. Both methods compensate for the DC voltage but do not provide any improvements in the reduction of power dissipation of the source driver.

A method which cuts the power consumption of the source driver as well as compensates for the DC voltage is proposed in Japanese Pat. Laid-Open Gazette No. 157815/90. This method has, however, such a defect as mentioned below. After writing into pixel capacitors image signals corresponding to the positions of the pixels, it is necessary to turn OFF TFTs (thin film transistors) to hold therein the written charges. To perform this, the voltage that is applied to the gate of each TFT to turn it OFF needs to have a potential which sufficiently reduces it source-drain current $I_{DS}$. According to the disclosure of Pat. Laid-Open Gazette No. 157815/90, the write of the image signals into the pixel capacitors is followed by the application of a pulse $V_{e(+)}$ or $V_{e(-)}$. This impairs the charge retaining characteristic of the pixels.

Incidentally, the method of literature 2 uses, as a pulse $-V_E$, the pulse identified by $V_{e(-)}$ in Pat. Laid-Open Gazette No. 157815/90, and hence has the same defect as does the latter.

A first object of the present invention is to provide a method for AC-driving a liquid crystal display which provides an improved charge retaining characteristic of the pixels, and a liquid crystal display using the method.

A second object of the present invention is to provide a method for AC-driving a liquid crystal display which reduces the output power of the source driver, and a liquid crystal display using the method.

A third object of the present invention is to provide a method for AC-driving a liquid crystal display which is capable of compensating for the DC voltage which is caused by the dielectric anisotropy of liquid crystal or the like, and a liquid crystal display using the method.

DISCLOSURE OF THE INVENTION (1) According to a first aspect of the present invention, a gray-scale level signal $V_a$, which is applied to each pixel on a selected gate bus, is added, with its polarity inverted every predetermined period, to first and second source bias voltages $V_{S+}$ and $V_{S-}$ which are generated alternately at predetermined constant alternating periods, and the resulting voltages are provided as source voltages $V_S$ to the source buses. On the other hand, a gate voltage $V_G$, whose duration includes a period of a high-level gate pulse which holds a thin film transistor in the ON state during substantially one horizontal scanning period H in each frame period, a gate bias period which immediately and continuously precedes the rise of the gate pulse and during which first and second gate bias voltages $V_{x1}$ and $V_{x2}$ are alternately provided every said alternating period, and a period of a predetermined low-level voltage $V_{GL}$ which holds the thin film transistor in the OFF state during the frame period except for the gate pulse period and the gate bias period, is applied to the gate buses so that the gate pulses fed thereto are displaced one horizontal scanning period H apart in a sequential order. The gate bias period of an i-th row has a wide span from the rise of the gate pulse of that row to the time instant preceding the fall of the immediately preceding gate pulse of an (i-1)th row. By this, the first and second gate bias voltages $V_{x1}$ and $V_{x2}$, which are provided to the i-th row, are alternately added to the gate voltage in a negative and a positive write period in the AC-wise driving of the pixels on the (i-1)th row, respectively.

(2) According to a second aspect of the present invention, in the above-mentioned first aspect, the bias voltage $V_{x1}$ and $V_{x2}$ are determined so that they bear the relationships, $V_{x1}>V_{GL}$ and $V_{X2}<V_{GL}$, to the low level $V_{GL}$.

(3) According to a third aspect of the present invention, in the above-mentioned first aspect, the bias voltages $V_{x1}$ and $V_{x2}$ are determined so that they bear the relationships, $V_{x1}\leqq V_{GL}$ and $V_{x2}>V_{GL}$, to the low level $V_{GL}$.

(4) According to a fourth aspect of the present invention, in any one of the first through third aspects, the gate pulse $P_G$ is not added to the gate voltage $V_{Gm+1}$ of the last gate bus and this gate voltage is added with the first and second bias voltages $V_{x1}$ and $V_{x2}$ alternately and then goes to the non-select level $V_{GL}$ each time.

(5) According to a fifth aspect of the present invention, in any one of the first through fourth aspects, either one of a common voltage $V_c$ for application to the common electrode and the average value, $(V_{x1}+V_{x2})/2$, of the first and second bias voltages $V_{x1}$ and $V_{x2}$ is set to a given value and the other is set to a value that satisfies a condition that $V_C=V_{do}$ (the center value of the drain potential).

(6) According to a sixth aspect of the present invention, in any one of the first through fourth aspects, the difference, $V_{x1}-V_{x2}$, between the first and second bias voltages $V_{x1}$ and $V_{x2}$ is adjusted while holding their average value $(V_{x1}+V_{x2})/2$ unchanged, and the peak-to-peak value $V_{Dpp}$ of the drain voltage of the TFT is set to a given value while holding the peak-to-peak value $V_{Spp}$ of the output voltage of the source driver unchanged.

(7) According to a seventh aspect of the present invention, in any one of the first through fourth aspects, the peak-to-peak value $V_{Spp}$ of the output voltage of the source driver is adjusted and the peak-to-peak value $V_{Dpp}$ of the drain voltage of the TFT is set to a given value while holding the difference, $V_{x1}-V_{x2}$, between the first and second bias voltages $V_{x1}$ and $V_{x2}$ unchanged.

(8) According to an eighth aspect of the present invention, in the sixth or seventh aspect, the peak-to-peak value $V_{Spp}$ of the output voltage of the source driver is set to be equal to the maximum amplitude $V_{amax}$ of the gray-scale level signal $V_a$ contained in the output from the source driver.

(9) According to a ninth aspect of the present invention, in any one of the first through eighth aspects, an output voltage $k_1(V_{x1}+V_{x2})$ ($k_1$ being an arbitrary constant) from a first variable DC supply and an output voltage $k_2(V_{x1}-V_{x2})$ ($k_2$ being an arbitrary constant) from a second variable DC supply are calculated to obtain the first and second bias voltages $V_{x1}$ and $V_{x2}$.

(10) According to a tenth aspect of the present invention, in the fifth aspect, the average value, $(V_{x1}+V_{x2})/2$, of the first and second bias voltages is adjusted to make the center value $V_{do}$ of the drain voltage $V_{Dpp}$ equal to the center value of the source voltage $V_{Spp}$.

BEST MODE FOR CARRYING OUT THE INVENTION

Figure 1A:
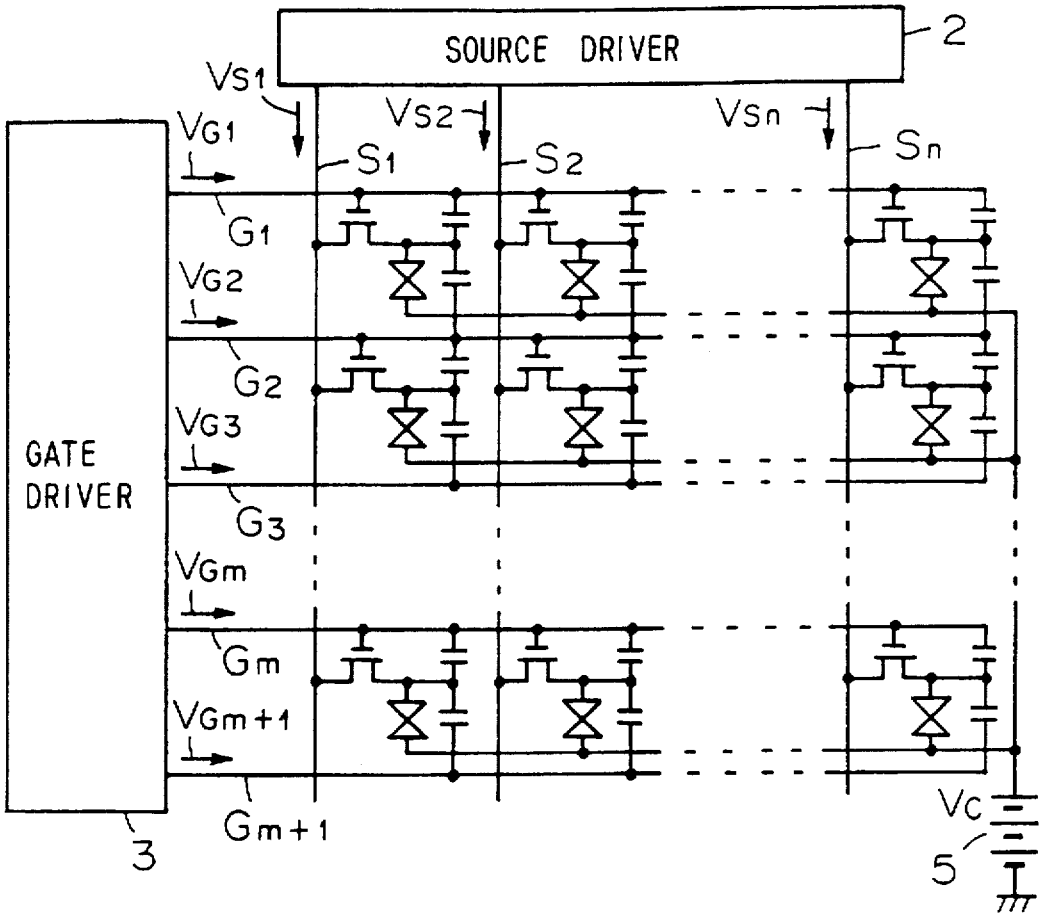
FIG. 1A is an equivalent circuit diagram illustrating the electrical construction of a liquid crystal display to which the present invention is applied.
Figure 1B:
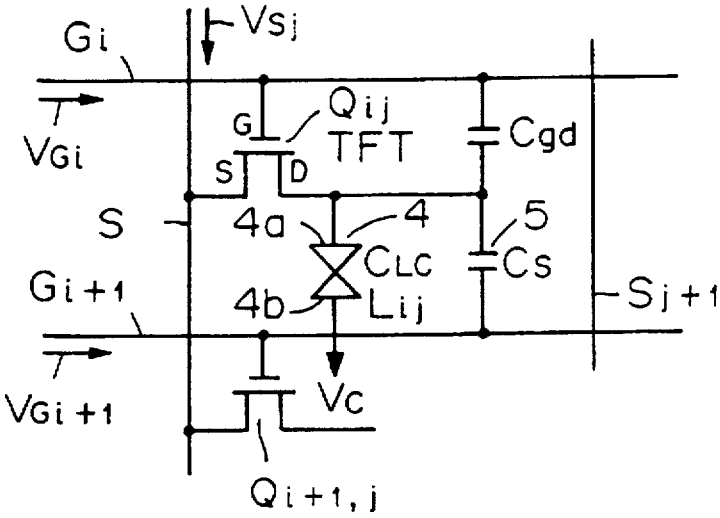
FIG. 1B is an equivalent circuit diagram of one pixel and its vicinity in FIG. 1A.
Figure 2:
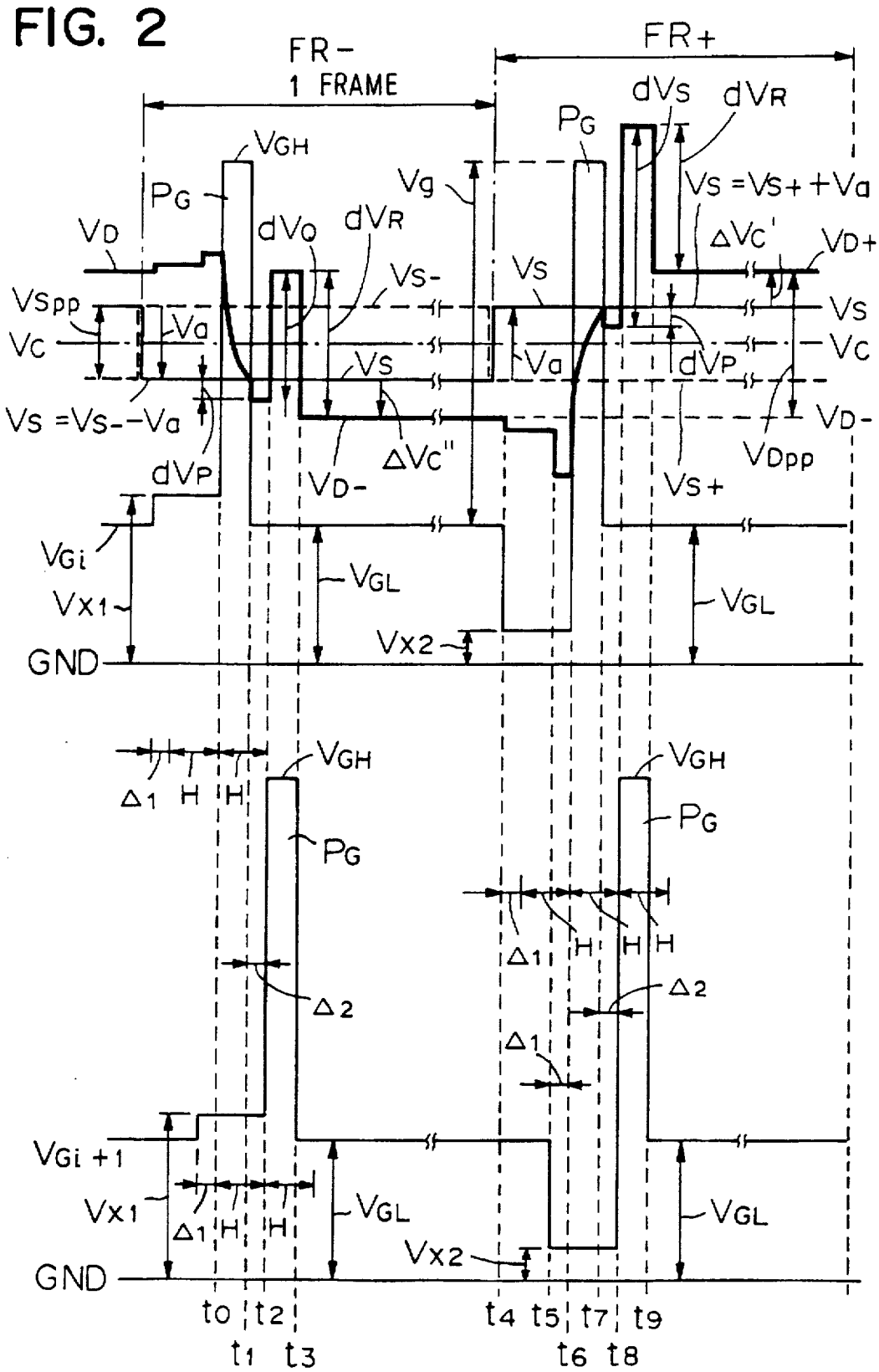
FIG. 2 is a waveform diagram for explaining the operation of the principal part of the display depicted in FIG. 1.

FIG. 1A is an equivalent circuit diagram showing the principal part of the AMLCD according to the present invention, FIG. 1B is an equivalent circuit diagram of one pixel on an i-th row of the display panel and FIG. 2 a waveform diagram showing drive signals for application to pixels in FIG. 1A according to the present invention.

A source driver 2 has connected thereto n columns of source buses $S_1$–$S_n$ and a gate driver 3 has connected thereto m+1 rows of gate buses $G_1$–$G_{m+1}$. In a mesh or area defined by the gate buses $G_i$, $G_{i+1}$ (i=1 to m) and the source buses $S_j$ (j=1 to n), there is disposed a liquid crystal pixel $L_{ij}$(FIG. 1B). In the vicinity of the intersection of the gate bus $G_i$ and the source bus $S_j$, there is disposed a TFT $Q_{ij}$ which is electrically connected to the respective buses. One of electrodes which hold therebetween a liquid crystal cell 4 of each liquid crystal pixel $L_{ij}$ is used as a display electrode 4a, which is connected to the drain D of the TFT $Q_{ij}$, and the other electrode is used as a common electrode 4b which is common to all cells and connected to a DC voltage source 6. Each pixel $L_{ij}$ has a signal storage capacitor 5. One electrode of the capacitor 5 is connected to the display electrode 4a and the other is connected to the gate bus $G_{i+1}$.

The source driver 2 provides to the respective source buses $S_j$ at the same time, for application to j columns of pixels $L_{1j}$, $L_{2j}$, . . . , $L_{mj}$, signal voltages (referred to also as source bus drive voltages or source voltages) $V_{1j}$, $V_{2j}$, . . . , $V_{mj}$ (identified generically by $V_{Sj}$ or $V_S$) of a duration substantially equal to or shorter than one horizontal scanning time H. The gate driver 3 supplies the gate buses $G_1$, $G_2$, . . . , $G_{m+1}$, one after another with pulse-like scanning voltages (referred to also as gate bus drive voltages or simply as gate voltages) $V_{G1}$, $V_{G2}$, . . . , $V_{Gm+1}$ which remain low-level except for substantially one horizontal scanning period H and are sequentially displaced one horizontal scanning period apart in phase.

By this, TFTs on each row are sequentially selected and turned ON. is a diagram showing an equivalent circuit of the pixel in one mesh in In FIG. 1B, $C_{gd}$ denotes a parasitic capacitance between the gate and drain of the TFT, $C_{LC}$ the pixel capacitance of the liquid crystal cell 4 and $C_S$ the storage capacitance of the signal storage capacitor 5.

FIG. 2 shows typical waveforms of the source voltage $V_{Sj}$ (identified by $V_S$ for brevity's sake), the gate voltage $V_{Gi}$, $V_{Gi+1}$ and a drain voltage $V_D$ at the time of driving the liquid crystal pixel $L_{ij}$ in the FIG. 1B embodiment. Incidentally, $V_c$ denotes a common voltage that is applied from the DC voltage source 6 to the common electrode 4b. $V_{S-}$ and $V_{S+}$ denote bias voltage (source voltages when a display gray-scale level signal $V_a$ is zero) that are used to effect a negative and a positive write for AC-wise driving of the liquid crystal pixel, respectively. The gray-scale level signal $V_a$ is indicated by the arrow, the length and direction of the arrow indicating the magnitude of the signal and the polarity in which the signal is written in the pixel. In this specification, charging of the pixel capacitor from the source bus through the TFT turned ON by a gate pulse $P_G$ a select level is called a write. For AC-wise driving of the liquid crystal cell, the gray-scale level signal $V_a$ is written into the pixel with the polarity inverted every frame; the write of the positive gray-scale level signal $V_a$ is called a positive write and the write of the negative signal $V_a$ a negative write. Usually, a commercially available source driver for AMLCD can be used to implement a source driver circuit equivalent to the source driver which, for the abovementioned AC-wise driving of the liquid crystal cell, applies first and second source bias voltages to the source bus alternately with each other and adds the gray-scale level signal $V_a$ to the bias voltages while inverting its polarity.

The difference between a non-select level (a level at which to turn OFF the TFT) and a select level (a level at which to turn ON the TFT) of the gate voltage $V_G$ is represented by Vg and the two bias voltages that are provided following an AC-wise signal (not shown) are identified by $V_{x1}$ and $V_{x2}$.

The gate voltage $V_{Gi}$ (i=1 to m+1) which is applied to each gate bus $G_i$ from the gate driver 3 has in every frame period a rectangular gate pulse $P_G$ of the high level (the select level) $V_{GH}$ with a fixed duration shorter than the horizontal scanning period H and the remaining portion of the low level $V_{GL}$. In the first aspect of the present invention, it is the most outstanding feature that the gate voltage $V_{Gi}$ on each gate bus $G_i$ has a period of about 1H width (in the example of FIG. 2, for a period $1H+\Delta_1$ is longer than -H but shorter than one frame period) immediately preceding the gate pulse $P_G$ in which the first and second bias voltages $V_{x1}$ and $V_{x2}$ alternate every frame. Hence, the periods of the first and second gate bias voltages on the gate bus $G_i$ each cover at least the fall time or entire duration of the gate pulse P on the immediately preceding gate bus $G_{i-1}$. Accordingly, the first and second gate bias period on an i-th row correspond to the negative and positive write periods in the AC-wise driving of pixels on an (i-l)th row, respectively.

Similarly, the gate voltage $V_{Gi+1}$ which is applied to the gate bus $G_{i+1}$ contains the first and second bias voltages $V_{x1}$ and $V_{x2}$ which are added to the low level $V_{GL}$ during the negative write and positive write in the pixel $L_{ij}$, respectively, as shown in FIG. 2.

Figure 10:
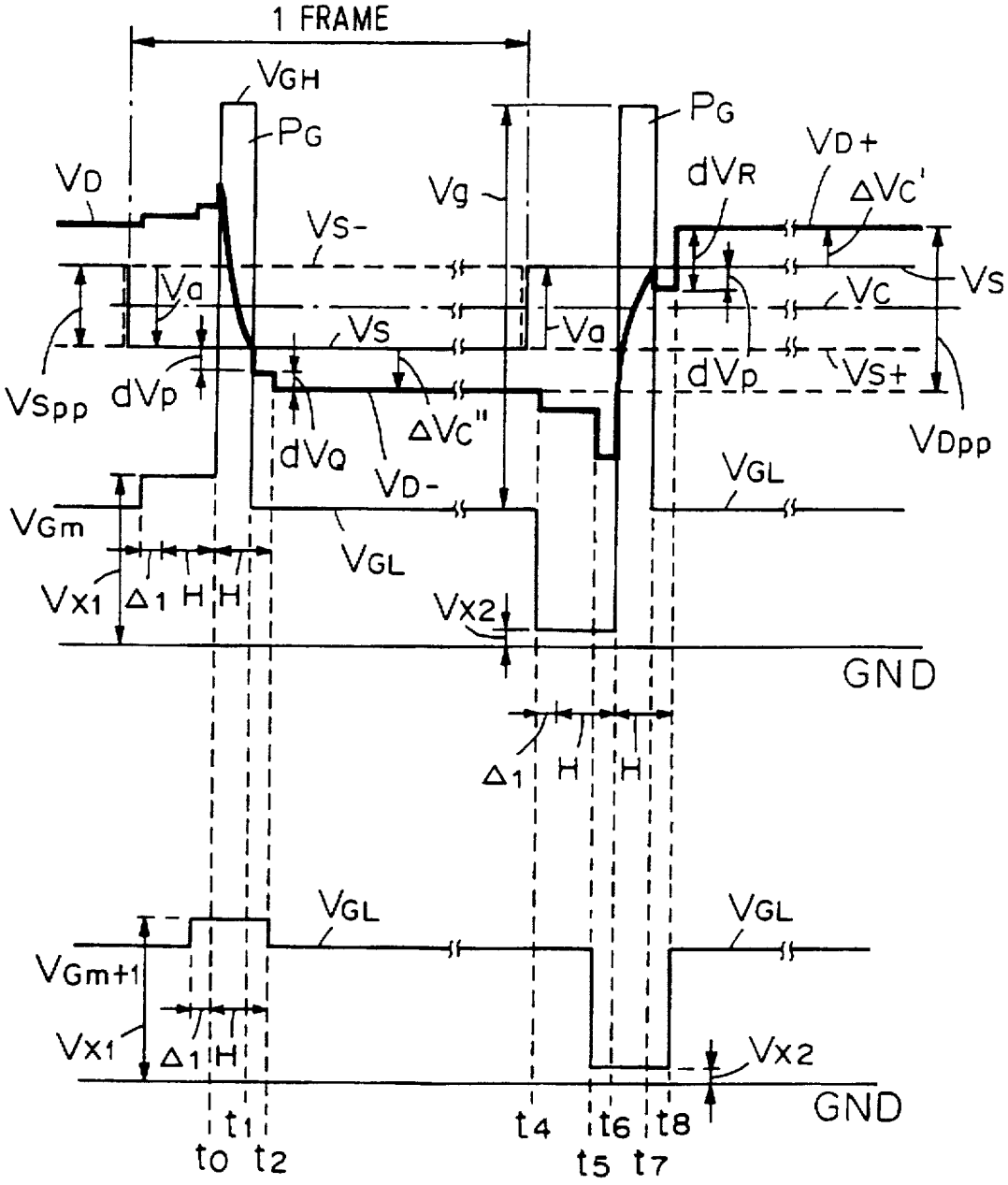
FIG. 10 is a waveform diagram for explaining the operation when the gate pulse $P_G$ is not added to the gate voltage $V_{Gm+1}$ of the last gate bus alone in FIG. 1A.

In the fourth aspect of the present invention described later, provision is made for preventing the gate voltage $V_{Gm+1}$ to the last gate bus from having the gate pulse $P_G$ as depicted in FIG. 10. The reason for this is that neither pixels nor TFTs are provided on the row m+1 and the exclusion of the gate pulse does not exert bad influence on the pixels and TFTs on the m-th row.

Next, the present invention will be described in detail following the elapse of time from $t_0$ to $t_3$ shown in FIG. 2.

In $t \leqq t_0$ to the drain voltage $V_D$ of each TFT on the i-th row, written therein at the time of application of the gate select pulse (the gate pulse) $P_G$ in the preceding frame, is being held at a shifted potential. In the subsequent period $t_0<t<t_1$ the TFT on the i-th row is turned ON by the select pulse $P_G$ and new data is written by the source voltage $V_S$. In consequence, the capacitors $C_{gd}$, $C_{LC}$ and $C_S$ are charged until the drain potential $V_D$ reaches the source potential $V_S=V_{S-}-V_a$.

Figure 3A:
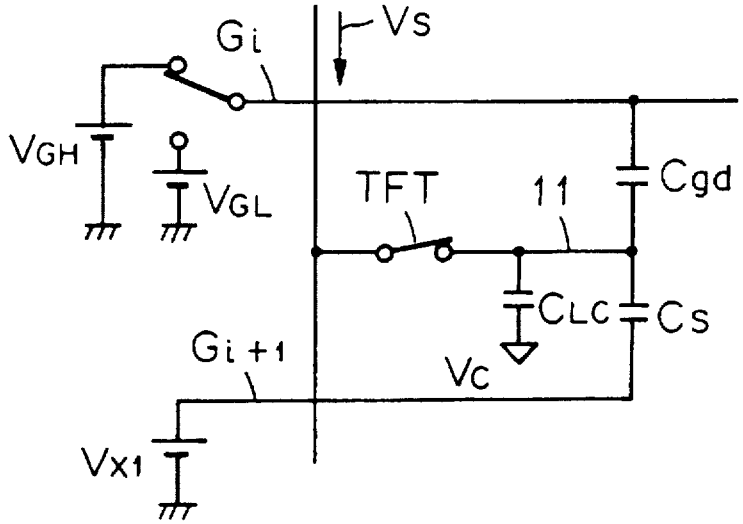
FIG. 3A is an equivalent circuit diagram for explaining the migration of charges at the time when a TFT is in the ON state in FIG. 1B.

At $t=t_1$ the gate potential $V_{GL}$ drops to the level $V_{GL}$. FIG. 3A shows an equivalent circuit including the gate driver at $t_0<t<t_1$ and FIG. 3B a similar equivalent circuit at $t_1<t<t_2$. In FIG. 3A, since the TFT is ON, the potential at a circuit point 11, that is, the drain voltage is equal to $V_S$. Accordingly, the total amount of charges, $q_A$, that are stored in the capacitors $C_{gd}$, $C_{LC}$ and $C_S$ is as follows:

$$q_A=C_{LC}(V_S-V_C)+C_S(V_S-V_{x1})+C_{gd}(V_{GH}-V_S) \quad (1)$$

Figure 3B:
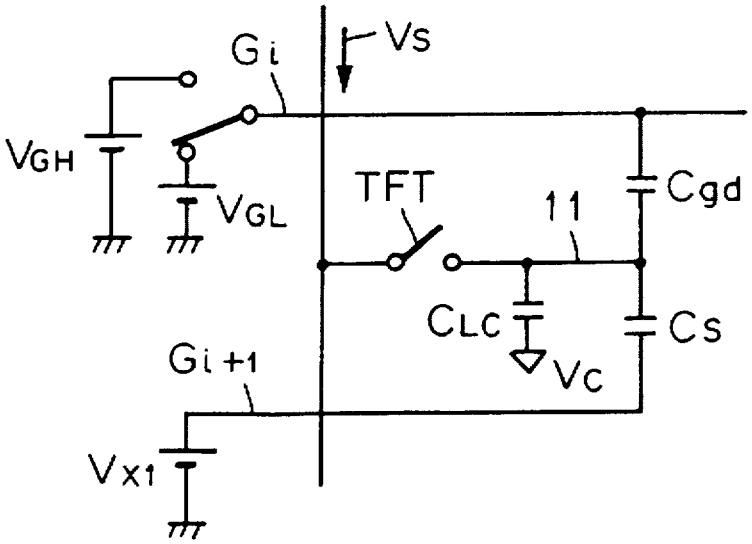
FIG. 3B is an equivalent circuit diagram for explaining the migration of charges at the time when the TFT is in the OFF state in FIG. 1B.

Letting the drain potential at the circuit point 11 in FIG. 3B be represented by $V_D$, the total amount of charges, $q_B$, that are stored in the capacitors $C_{gd}$, $C_{LC}$ and $C_S$ is as follows:

$$q_B=C_{LC}(V_D-V_C)+C_S(V_D-V_{x1})+C_{gd}(V_D-V_{GL}) \quad (2)$$

Since Eqs. (1) and (2) are equal according to the principle of conservation of charge, the following equation (3) holds;

$$C_{LC}(V_S-V_C)+C_S(V_S-V_{x1})+C_{gd}(V_S-V_{GH})=C_{LC}(V_D-V_C)+C_S(V_D-V_{x1})+C_{gd}(V_D-V_{GL}) \quad (3)$$

Rearranging Eq. (3), we have $$(C_{LC}+C_S+C_{gd})(V_S-V_D)=C_{gd}(V_{GH}-V_{GL})$$

Hence, $$V_S-V_D=[C_{gd}/(C_{LC}+C_S+C_{gd})](V_{GH}-V_{GL}) \quad (4)$$

Setting $$V_S-V_D=dV_p \quad (5)$$

Eq. (4) becomes as follows:

$$dV_p=[(C_{gd}/(C_{gd}+C_S+C_{LC})](V_{GH}-V_{GL}) \quad (6)$$

That is, the drain voltage $V_D$ shifts downward by $dV_p$ expressed by Eq. (6). Incidentally, it is known from the aforementioned literature 1, for instance, that the drain voltage $V_D$ shifts by the gate pulse as mentioned above.

In the period $t_1<t<t_{21}$, since the TFT on the i-th row is OFF, the drain voltage $V_D$ remains unchanged and is held at $V_s-dV_p$.

At $t=t_2$, the select level $V_{GH}$ is provided to the gate of the TFT on the (i+l)th row. By this, the drain potential at the circuit point 11 on the i-th row shifts in proportion to the potential $V_{GH}$ applied from the $C_S$ side in FIG. 3B. The shift amount $dV_Q$ is calculated on the same principle as that for the shift of the drain voltage by Eq. (6), and the drain potential shifts upward by $dV_Q$ which is given by the following equation (7):

$$dV_Q=[C_S/(C_{gd}+C_{LC}+C_S)](V_{GH}-V_{x1}) \quad (7)$$

In the period $t_2<t<t_3$, the drain potential $V_D$ of the TFT on the i-th row remains unchanged.

At $t=t_3$, the non-select level $V_{GL}$ is provided to the gate of the TFT on the (i+l)th row. By this, the drain potential $V_D$ on the i-th row shifts in proportion to the applied potential. The shift amount $dV_R$ is calculated on the same principle as that for the shift by Eq. (6), and the drain potential shifts downward by the amount that is given by the following equation (8):

$$dV_R=[C_S/(C_{gd}+C_{LC}+C_S)](V_{GH}-V_{GL}) \quad (8)$$

After all, the total shift amount $\Delta V_C''$ of the drain potential $V_D$ in the period from $t=t_1$ to $t=t_3$ is expressed by the following equation:

$$\Delta V_C''=dV_p-dV_Q+dV_R \quad (9)$$

Substitution of Eqs. (6), (7) and (8) into Eq. (9) gives $$\Delta V_C''=[C_{gd}/(C_{gd}+C_{LC}+C_S)](V_{GH}-V_{GL})+[C_S/(C_{gd}+C_{LC}+C_S)](V_{x1}-V_{GL}) \quad (10)$$

Letting $V_{D-}$ (the minus sign meaning the negative write) denote the drain voltage on the i-th row in the period $t_3 \leqq t<t_4$ from time $t_3$ the gate pulse $P_G$ applied to the gate of the TFT on the (i+1)th row falls to the time immediately preceding time $t_4$ the second bias voltage $V_{x2}$ is applied to the gate of the RTFT on the i-th row, it is expressed as follows:

$$V_{D-}=V_{S-}-V_a-\Delta V_C'' \quad (11)$$

The potential difference between the drain voltage $V_{D-}$ and the common voltage $V_C$ is held as a display voltage for the liquid crystal cell 4 of the pixel $L_{ij}$ concerned in the frame $FR_-$ in which the negative write was effected.

In the period $t_4<t \leqq t_6$ of the second bias voltage $V_{x2}$ which is provided to the gate bus $G_i$ of the i-th row in the frame $FR_+$ period in which to effect the positive write—in FIG. 2 the drain potential $V_D$ is shown to vary in accordance with gate waveforms on the gate buses $G_i$ and $G_{i+1}$ on the assumption that the TFT is OFF—even if the TFT is in the ON state and its drain potential undergoes whatever variations in this period, it does not exert any influence on the drain potential at $t \geqq t_7$ since in the period $t_6<t<t_7$ following time instant $t_6$ new data is written into the TFT by the gate pulse $P_G$ which is applied to the gate bus $G_i$. For this reason, no description will be made of the fluctuation of the drain potential in this period.

During the period $t_6<t<t_7$ for which the gate pulse $P_G$ is fed to the gate bus $G_i$, the TFT of the i-th row is ON, and consequently, the capacitors $C_{gd}$, $C_{LC}$ and $C_S$ are charged until the drain potential $V_D$ reaches the source potential $V_S=V_{S+}+V_a$.

At $t=t_7$ the gate pulse $P_G$ falls as at $t=t_1$, in consequence of which the TFT of the i-th row is turned OFF and the drain potential shifts downward by $dV_p$ which is given by Eq. (6).

During $t_7<t<t_8$ the TFT of the i-th row remains OFF, and hence the drain potential $V_D$ remains unchanged.

At $t=t_8$ the gate pulse $P_G$ of the select level $V_{GH}$ is fed to the gate of the TFT of the (i+1)th row. At this time, the drain potential $V_D$ of the TFT on the i-th row shifts upward by the shift amount $dV_s$ given by the following equation as in the case of $t=t_2$:

$$dV_S=[C_S/(C_{gd}+C_{LC}+C_S)](V_{GH}-V_{x2}) \quad (12)$$

During $t_8<t<t_9$ over which the gate pulse $P_G$ is applied to the (i+1)th gate bus, the drain potential of the TFT on the i-th row remains unchanged.

At $t=t_9$ the non-select level $V_{GL}$ is provided to the gate of the TFT on the (i+1)th row. At this time, the drain potential $V_D$ of the TFT on the i-th row shifts downward by the amount which is given by the following equation as in the case of $t=t_3$:

$$dV_R[C_S/(C_{gd}+C_{LC}+C_S)](V_{GH}-V_{GL}) \quad (13)$$

After all, the total shift amount $\Delta V_c'$ of the drain potential $V_D$ in the period from $t=t_7$ to $t=t_9$ is expressed by the following equation:

$$\Delta V_C'=-d_{Vp}+dV_s-dV_R \quad (14)$$

Substitution of Eqs. (6), (12) and (13) into Eq. (14) gives $$\Delta V_C'=-[C_{gd}/(C_{gd}+C_{LC}+C_S)](V_{GH}-V_{GL})+[C_S/(C_{gd}+C_{LC}+C_S)](V_{GL}-V_{x2}) \quad (15)$$

Letting the drain potential at $t>t_9$ be represented by $V_{D+}$ (the plus sign meaning the positive write), it is expressed as follows:

$$V_{D+}=V_{S+}+V_a+\Delta V_c' \quad (16)$$

The potential difference between the drain potential $V_{D+}$ and the common voltage $V_c$ is held as a display voltage for the pixel $L_{ij}$ concerned at the time of positive write in the frame $FR_+$.

Next, the relationships among the source voltage $V_S$, the drain potential $V_D$, the common voltage $V_c$ and the two bias voltages $V_{x1}$ and $V_{x2}$ will be discussed on the basis of the description given above.

To implement AC-wise driving of liquid crystal, the common voltage $V_c$ to be applied to the common electrode 4b needs to match an average value $V_{do}$ of the drain potential $V_{D+}$ at the time of positive write and the drain potential $V_{D-}$ at the negative write so that they are symmetrical with each other. Hence, $$V_C=V_{do}\cong(V_{D+}+V_{D-})/2 \quad (17)$$

Substitution of Eqs. (11) and (16) into Eq. (17) gives $$V_C=V_{do}\cong(V_{s-}+V_{s+})/2(\Delta V_c' \text{ and } -\Delta V_c'')/2 \quad (18)$$

Substituting Eqs. (10) and (15) for $\Delta V_C''$ and $\Delta V_c'$ and rearranging Eq. (18), we have $$\begin{aligned} V_C &= V_{do} \\ &\equiv (v_{S-}+V_{S+})/2- \\ &\quad [C_{gd}/(C_{gd}+C_{LC}+C_S)](V_{GH}-V_{GL})- \\ &\quad [C_S/(C_{gd}+C_{LC}+C_S)][(V_{x1}+V_{x2})/2-V_{GL}] \end{aligned} \quad (19)$$

On the other hand, a peak-to-peak value, $V_{Dpp}=V_{D+}-V_{D-}$, of the drain potential is expressed by the following equation (20) from Eqs. (11) and (19):

$$\begin{aligned} V_{Dpp} &\equiv V_{D+}-V_{D-} \\ &= (V_{S+}+V_a+\Delta V_C')-(V_{S-}-V_a-\Delta V_C'') \\ &= (V_{S+}-V_{S-})+2V_a+\Delta V_C'+\Delta V_C'' \end{aligned} \quad (20)$$

Substituting Eqs. (15) and (10) for $V_C'$ and $V_C''$ in Eq. (20), respectively, we have $$\begin{aligned} V_{Dpp} &\equiv V_{D+}-V_{D-} \\ &= V_{S+}-V_{S-}+2V_a+ \\ &\quad [C_S/(C_{gd}+C_{LC}+C_S)](V_{x1}-V_{x2}) \\ &= V_{Spp}+[C_S/(C_{gd}+C_{LC}+C_S)](V_{x1}-V_{x2}) \end{aligned} \quad (21)\ (21')$$

Now, a description will be given of the points that must be noted in the analysis described above.

A. Eq. (19) will be discussed first. The first term, $((V_{s-}+V_{s+})/2$, on the right side of Eq. (19) represents an average value of the bias voltages $V_{s-}$ and $V_{S+}$ of the source voltage $V_s$ during the negative and the positive write and the average value is the center value of a peak-to-peak value of the source voltage $V_{Spp}$. It is the third term that must be noted. By adjusting the average value, $(V_{x1}+V_{x2})/2$, of the first and second bias voltages, the average value $V_{do}$ of the drain potential can freely be set.

To implement AC-wise driving of liquid crystal, the average value $V_{do}$ of the drain potential needs to be equal to $V_c$ (the common voltage). This requirement could be met by the two adjustment methods mentioned below.

(a) Adjust the common voltage $V_c$ to make it equal to the average value $V_{do}$ of the drain potential that is given by Eq. (19).

(b) Adjust the average value, $(V_{x1}+V_{x2})/2$, of the first and second bias voltages so that the average value $V_{do}$ of the drain potential becomes equal to a given common voltage $V_c$. The fifth aspect of the present invention features that either one of the common voltage $V_c$ and the average value $(V_{x1}+V_{x2})/2$ is given arbitrarily and the other is set to satisfy $V_c=V_{do}$.

B. Eqs. (21) and (21') will be discussed here. The last term should be noted. $V_{x1}-V_{x2}$ represents the difference between the first and second bias voltages which are applied to the gate. By adjusting the difference, $V_{x1}-V_{x2}$, between the first and second bias voltages $V_{x1}$ and $V_{x2}$, the drain voltage $V_{Dpp}$ can freely be set without changing the source voltage $V_{Spp}$. Furthermore, Eqs. (21) and (21') can be made to hold regardless of the average value, $(V_{x1}+V_{x2})/2$, of the bias voltages; according to the sixth aspect of the present invention, it is possible to freely set the drain voltage $V_{Dpp}$ while holding the source voltage $V_{Spp}$ constant by adjusting the difference $(V_{x1}-V_{x2})$ while holding the above-mentioned average value constant.

Figure 4A:
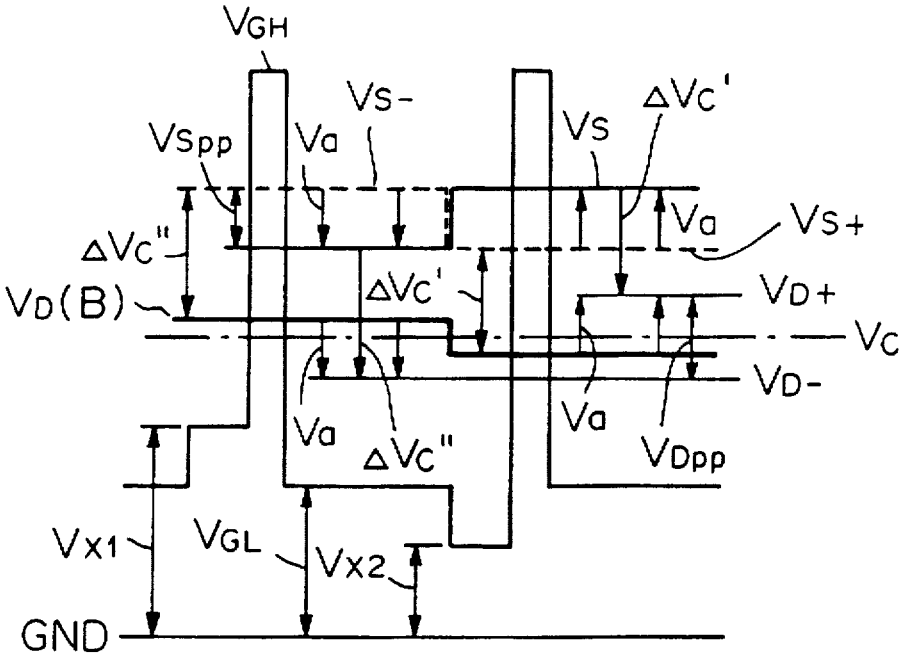
FIG. 4A is a waveform diagram for explaining one driving method in FIG. 1B.
Figure 4B:
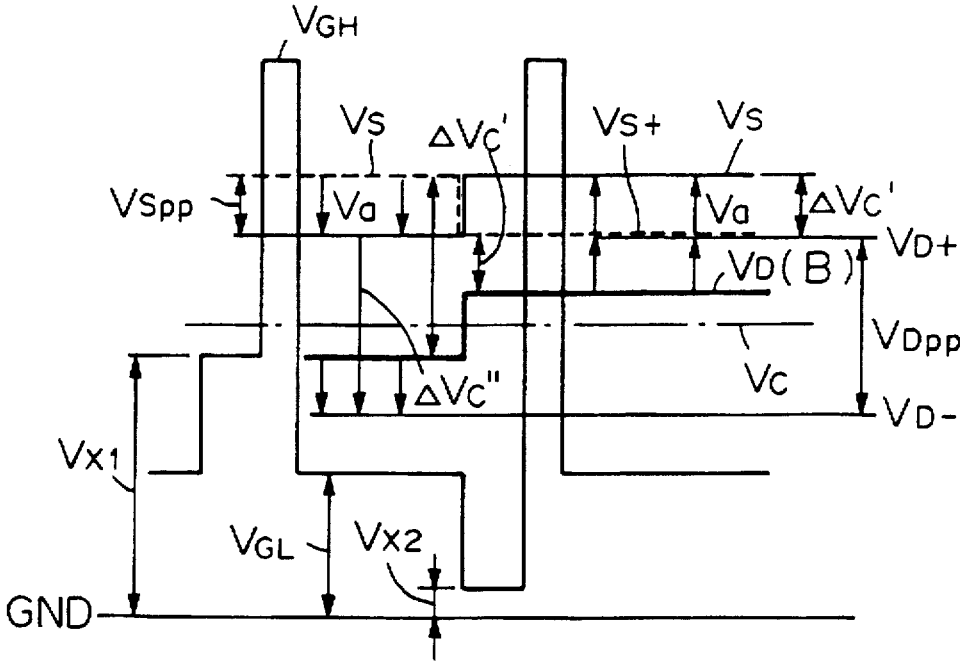
FIG. 4B is a diagram showing waveforms occurring in the principal parts when changing the drain voltage $V_{Dpp}$ while holding the source voltage $V_{Spp}$ unchanged in FIG. 4A.

FIGS. 4A and 4B show examples of drive voltage waveforms in the case of changing the drain voltage $V_{Dpp}$ while holding the source voltage $V_{Spp}$ constant. In FIGS. 4A and 4B, the thick lines indicate the case where the gray-scale level signal $V_a$ is zero. In the case of a display in black, the level is shown as the drain voltage $V_D(B)$, which assumes levels shifted from the source bias voltages $V_{S-}$ and $V_{S+}$ by $\Delta V_c''$ and $\Delta V_c'$, respectively. For an arbitrary value of the gray-scale signal $V_a$, the source voltage $V_s$ and the drain voltage $V_D$ are each shifted by the amount and in the direction indicated by the arrow $V_a$. In FIGS. 4A and 4B, the peak-to-peak value $V_{Dpp}$ of the drain voltage is set to a different value by setting the difference $(V_{x1}-V_{x2})$ to a different value without changing the average value, $(V_{x1}+V_{x2})/2$, of the first and second bias voltages. However, the source signals $V_{s-}-V_a$ and $V_{s+}+V_a$ remain unchanged in FIGS. 4A and 4B.

Figure 5A:
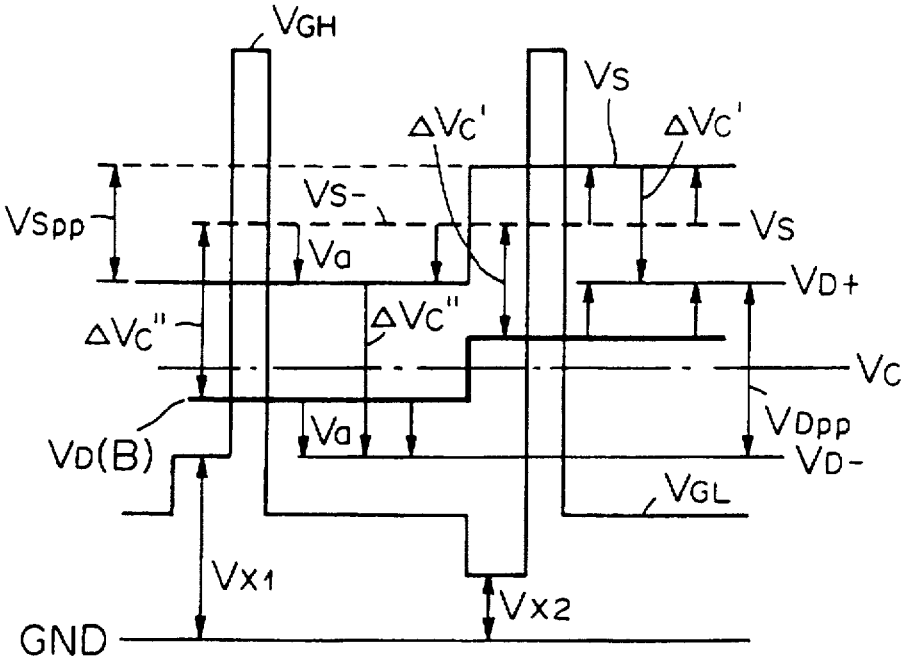
FIG. 5A is a waveform diagram for explaining another driving method in FIG. 1B.
Figure 5B:
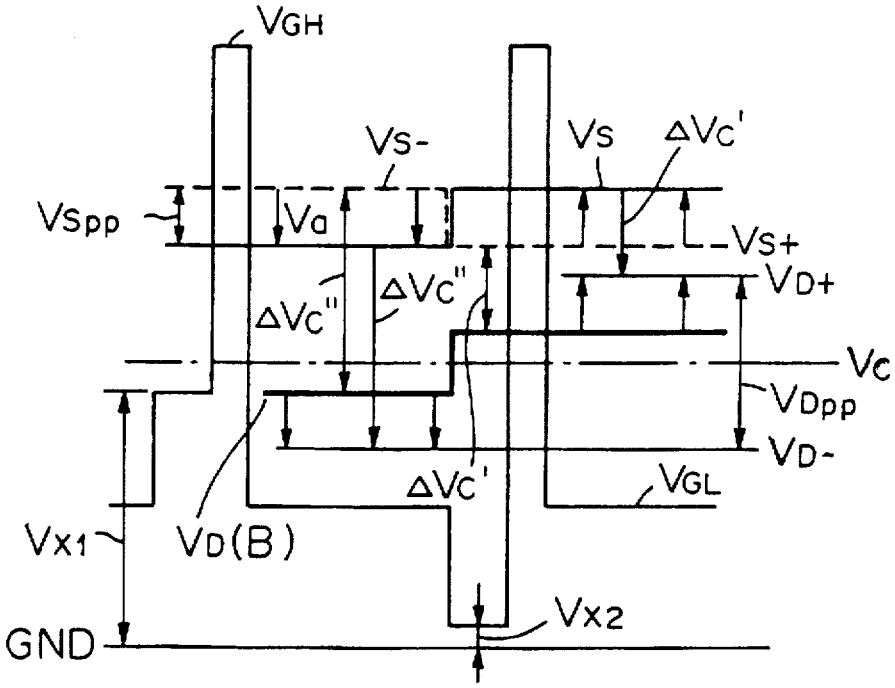
FIG. 5B is a diagram showing waveforms occurring in the principal parts when changing the source voltage $V_{Spp}$ while holding the drain voltage $V_{Dpp}$ unchanged in FIG. 5A.

Moreover, as shown in FIGS. 5A and 5B, according to Eqs. (21) and (21'), the peak-to-peak value, $(V_{S+}+V_a)-(V_{S-}-V_a)\cong V_{Spp}$, of the source voltage (and the peak-to-peak value, $(V_{S-}-V_{s+})$, of the source voltage for a display in black in which case $V_a=0$) can be changed by adjusting the difference $(V_{x1}-V_{x2})$ while holding constant the peak-to-peak value, $V_{Dpp}=V_{D+}-V_{D-}$, of the drain potential.

It is also evident that, in FIG. 5A, for instance, the peak-to-peak value $V_{Dpp}$ of the drain voltage can similarly be set to an arbitrary value through adjustment of the peak-to-peak value $V_{Spp}$ of the source voltage by Eqs. (21) and (21') (the seventh aspect of the present invention).

Under special circumstances the peak-to-peak value $V_{Spp}$ of the source voltage $V_s$ may be made equal to the maximum amplitude $V_{amx}$ of the gray-scale level signal $V_a$ as shown in FIGS. 2, 4A, 4B and 5B (the eighth aspect of the present invention). In this instance, since the following equation holds $$V_{Spp}\cong(V_{s+}+V_a)-(V_{S-}-V_a)=V_a \tag{22}$$

the following equation holds from Eq. (22)

$$V_{s-}-V_{s+}=V_a \tag{23}$$

In the case of FIG. 5A, the peak-to-peak value $V_{Spp}$ is set as expressed by the following equation.

$$V_{Spp}\cong(V_{s+}+V_a)-(V_{S-}-V_a)=2V_a \tag{24}$$

Hence, from Eq. (24) we obtain $$V_{S+}=V_{s-} \tag{25}$$

A decrease in the output $V_{Spp}$ from the source driver causes a decrease in its output power in proportion to the square of the output; therefore, the output power of the source driver can be minimized by setting the source driver output $V_{Spp}$ to a value equal to the maximum one $V_{amx}$ of the gray-scale level signal $V_a$.

While in the above the embodiments of the AC-wise driving methods according to the respective aspect of the invention have been described to invert the polarity of the gray-scale level signal by the source driver every frame, it is also possible to employ a well-known interlinear AC-wise driving method (which inverts the polarity every row); a discussion will be made of the output power of the source driver in this instance.

Figure 6A:
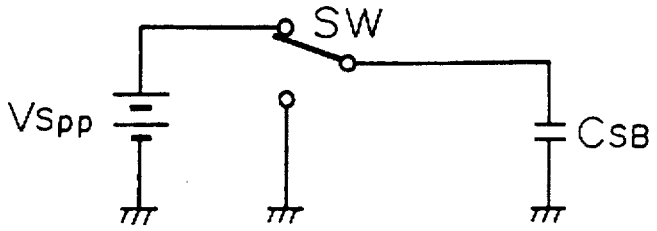
FIG. 6A is a diagram showing an approximately equivalent circuit for driving one source bus by the source driver in FIG. 1A.

The source buses, which are loads on the source driver, are capacitive loads. Letting the equivalent capacitance per bus be represented by $C_{SB}$ as shown in FIG. 6A, a charge of $C_{SB}.V_{Spp}$ [C] flows to the ground GND via a capacitor $C_{SB}$ from a battery $V_{Spp}$ in two horizontal scanning periods 2H. Hence, the output power $P_S$ of the source driver is as follows:

$$P_S=n.C_{SB}.(f_H/2).V_{SPP}^2 \text{ [W]} \tag{26}$$

where $f_H$ is the frequency of a horizontal synchronizing signal and n is the total number of source buses.

Figure 6B:
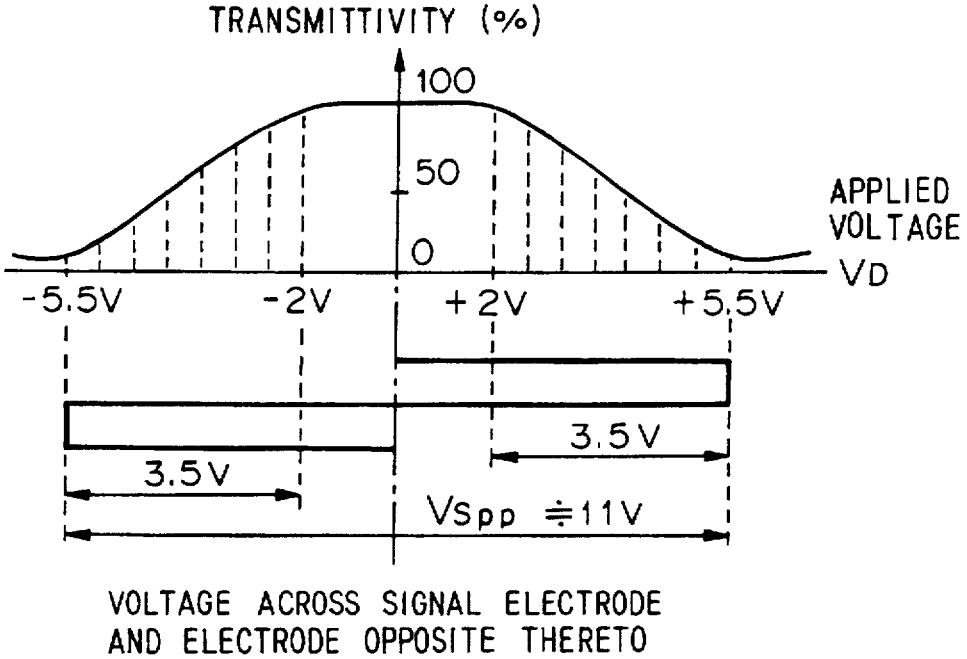
FIG. 6B is a graph showing an example of the applied voltage vs. transmittivity characteristic of liquid crystal.

FIG. 6B is a graph showing the relationship between the voltage (on the abscissa) applied across the pixel electrode and the common electrode and the transmittivity of a normally white liquid crystal cell (on the ordinate) in the case of the conventional AC-wise driving method. With the conventional AC-wise driving scheme, the peak-to-peak value $V_{Spp}$ of the source voltage needs to be 11 V, at least twice higher than the maximum gray-scale level $V_{amx}$, as shown in FIG. 6B. In contrast to this, in the AC-wise driving method according to the seventh aspect of the present invention (FIGS. 2, 4A, 4B and 5B), the peak-to-peak value $V_{Spp}$ can be selected, and hence needs only to be equal to the gray-scale level signal $V_a$ of 3.5 V. Thus, assuming that n=2000, $C_{SB}$=100 pF and $f_H$=30 kHz, the drive power that is needed in the conventional driving method is $P_S\approx363$ mW, whereas in the AC-wise drive method according to the fifth aspect of the present invention $P_s\approx36.8$ mW.

As will be seen from the above, the problem in operating the AMLCD is the power for charging the buses, not the power for charging the pixel capacitances.

On the other hand, in the drive method of the present invention the first and second bias voltages $V_{x1}$ and $V_{x2}$ alternately precede the rise of the conventional gate pulse; this causes an increase in the output power of the gate driver, which will hereinbelow be discussed in respect of the second aspect of the invention (that is, $V_{x1}>V_{GL}>V_{x2}$).

Figure 6C:
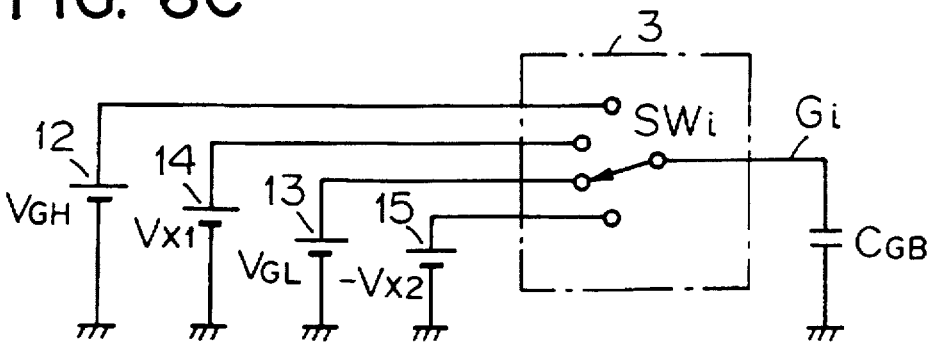
FIG. 6C is a diagram showing an approximately equivalent circuit for driving one gate bus by the gate driver in FIG. 1A.

The gate buses, which are loads on the gate driver, are also capacitive loads as is the case with the aforementioned source buses. Letting the equivalent capacitance of each gate bus be represented by $C_{GB}$, an equivalent gate drive circuit for each gate bus is such as depicted in FIG. 6C. Voltages $V_{GH}$, $V_{GL}$, $V_{x1}$ and $V_{x2}$ from a first gate voltage source 12, a second gate voltage source 13, a first bias voltage source 14 and a second bias voltage source 15 are respectively provided to the gate driver, wherein they are selected by a switch $SW_i$ corresponding to the respective gate bus $G_i$, in a predetermined sequential order and at predetermined timing for output to the corresponding gate bus $G_i$. The output power of the gate driver 3 is to charge and discharge the equivalent capacitance $C_{GB}$.

With the drive method of the present invention, in the frame during which the first bias voltage $V_{x1}$ is provided from the first bias voltage source 14, the equivalent capacitance $C_{GB}$ is charged first up to $V_{x1}$ and then up to $V_{GH}$. Then, the charges thus stored are discharged down to $V_{GL}$—this means the migration of charges of $C_{GB}(V_{GH}-V_{GL}) \doteq C_{GB}.V_g$ [C]. Also in the conventional drive method which does not utilize the first bias voltage $V_{x1}$, the equivalent capacitance $C_{GB}$ is charged up to $V_{GH}$ and the stored charges are discharged down to $V_{GL}$; hence, the amount of migration of charges is the same as in the present invention. The migration of charges takes place in the form of a current; the current does not change, whether the bias voltage is used or not. Accordingly, no increase in the output power is caused by newly providing the bias voltage $V_{x1}$.

In the frame during which the second bias voltage $V_{x2}$ is provided from the second bias voltage source 15, the equivalent capacitance is charged first up to $V_{x2}$ and then up to $V_{GH}$. Then, the charges thus stored are discharged down to $V_{GL}$—this means the migration of the following charges.

$$C_{GB}[V_{GH}-V_{GL}-(V_{x2}-V_{GL})]=C_{GB}(V_g+V_{GL}-V_{x2})[C]$$

In the above, the migration of the charge $C_{GB}.V_g$ occurs in the conventional drive method as well; accordingly, the increase in the output power solely by the second bias voltage $V_{x2}$ needs to be taken into account. Thus, the increase in the output power of the gate driver is such as given by the following equation $$\Delta P_G=m.C_{GB}.f_v.(V_{GL}-V_{x2})^2/2\ [W] \quad (27)$$

where $f_v$ is the frequency of a vertical synchronizing signal. In a typical example wherein $C_{GB}$=500 pF, $f_v$=60 Hz, m=500 and $V_{x2}$=10 V, the increase in the output power of the gate driver is 0.75 mW, very small as compared with the decrease in the supply power of the source driver, 363-37=326 mW.

As will be understood from the above, when the bias voltages $V_{x1}$ and $V_{x2}$ are higher than the voltage $V_{Gl}$, the power of the gate driver does not increase. It is when the bias voltage $V_{x1}$ or $V_{x2}$ is lower than the voltage $V_{GL}$ that the power of the driver increases. In the case of the third aspect of the present invention, since $V_{x1} \leqq V_{GL}$ and $V_{x2} \leqq V_{GL}$, the output power of the gate driver is increased not only by the bias voltage $V_{x2}$ according to Eq. (27) but also by the bias voltage $V_{x1}$ which is substituted for $V_{x2}$ in Eq. (27). Even in a typical example wherein $V_{x1}$=−3 V and the other values are such as mentioned above, the increase in the output power by the first bias voltage is 0.07 mW and even if added with the increase by the second bias voltage $V_{x2}$, the total amount of power increased is only 0.82 mW. Thus, the seventh aspect of the present invention permits effective power savings throughout the display device.

Figure 7:
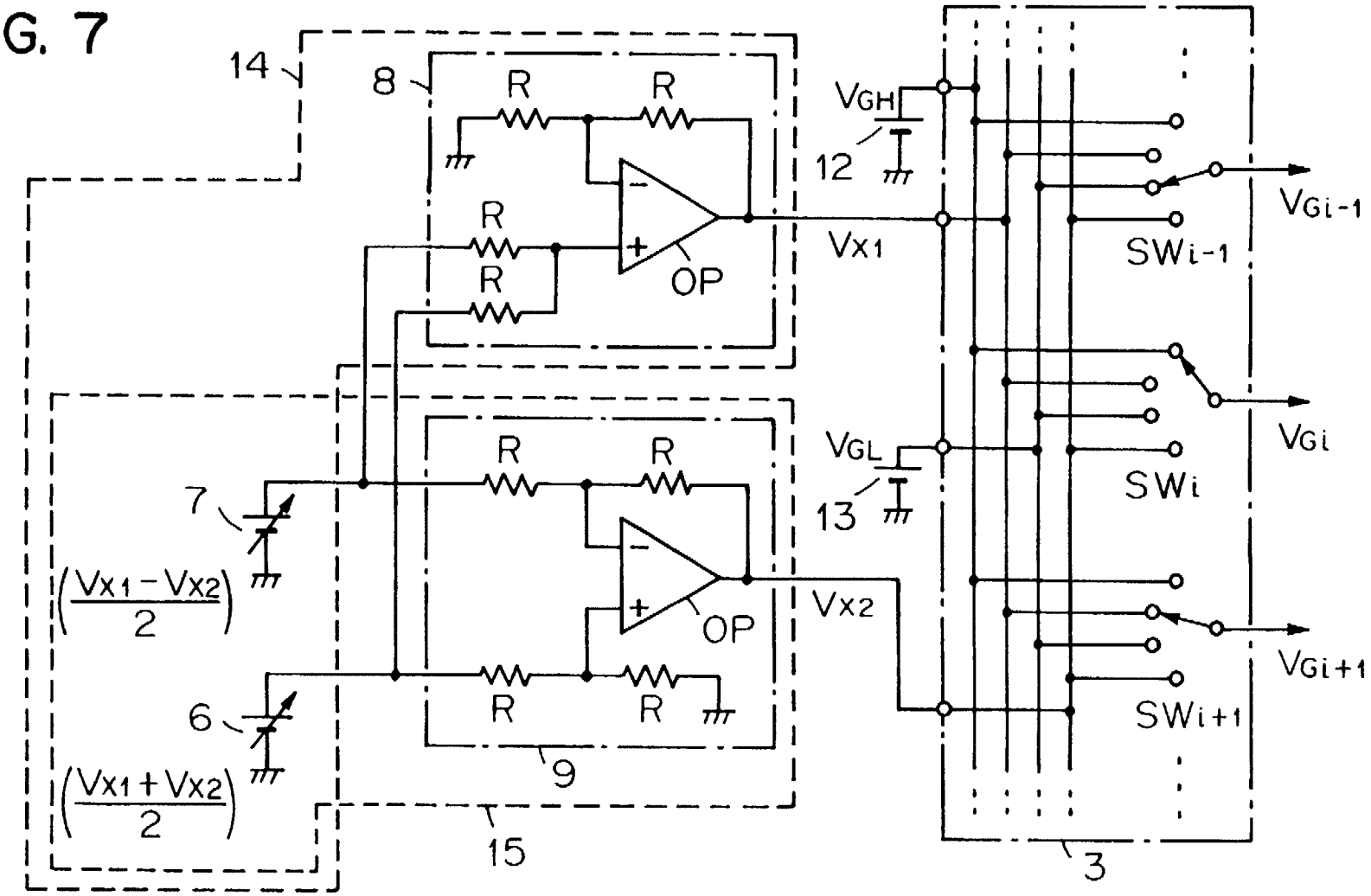
FIG. 7 is a diagram illustrating, by way of example, the gate driver and voltage source circuits for generating drive voltages to be applied to the gate driver in FIG. 1A.

C. Next, a description will be given of a bias generator for supplying the first and second bias voltages $V_{x1}$ and $V_{x2}$ to the gate driver 3 which is used in the above-described embodiments. To make the drain center voltage $V_{do}$ equal to the common voltage $V_c$ as indicated by Eq. (19), it is necessary that a $k_1$ (an arbitrary constant) multiple of the sum of the first and second bias voltages, $k_1(V_{x1}+V_{x2})$, be variable. Furthermore, to set the drain voltage $V_{Dpp}$ of source bus drive voltage $V_{Spp}$ to a predetermined value in relation to Eq. (21'), it is necessary that a $k_2$ (an arbitrary constant) multiple of the difference between the first and second bias voltages, $k_2(V_{x1}-V_{x2})$, be variable. In addition, it is desirable that $k_1(V_{x1}+V_{x2})$ and $k_2(V_{x1}-V_{x2})$ be adjustable independently of each other. In FIG. 7 there is shown an example of the power supply circuit for the gate driver which satisfies these requirements.

The output from a variable voltage source 61, which generates a voltage corresponding to a desired voltage value $(V_{x1}+V_{x2})/2$, and the output from a variable voltage source 7, which generates a voltage corresponding to a desired voltage value $(V_{x1}-V_{x2})/2$, are fed into an adder circuit 8 and a subtractor circuit 9, wherein they are added together and subtracted one from the other to obtain the first and second bias voltages $V_{x1}$ and $V_{x2}$. The first and second variable voltage sources 61 and 7 and the adder circuit constitute a first bias voltage source 14 which outputs the first bias voltage $V_{x1}$, and the first and second variable voltage sources 61 and 7 and the subtractor circuit 9 constitute a second bias voltage source 15 which generates the second bias voltage $V_{x2}$. These bias voltages are applied to the gate driver 3 together with the gate select level $V_{GH}$ from the first gate voltage source 12 and the non-select level $V_{GL}$ from the second gate voltage source 13, and they are adequately selected by the switch $SW_i$(i=1 to m+1) corresponding to the respective gate bus $G_i$ to generate the gate bus drive voltage $V_{Gi}$.

In FIG. 7, it is also possible to generate voltages $k_1(V_{x1}+V_{x2})$ and $k_2(V_{x1}-V_{x2})$ from the first and second variable voltage sources 61 and 7 and properly add them together and subtract them one from the other in the adder circuit 8 and the subtractor circuit 9, respectively (the ninth aspect of the present invention).

D. It must be noted that the bias voltages $V_{x1}$ and $V_{x2}$ are provided immediately prior to the application of the gate select level $V_{GH}$. It-has already been described with reference to the prior art in this specification that the application of the bias voltages $V_{x1}$ and $V_{x2}$ to the TFT causes an increase in the source-drain current $I_{DS}$, incurring the possibility of partly rewriting the gray-scale level signal $V_a$ written in the pixel. With the scheme of the present invention, however, even if the gray-level signal written in the pixel is partly rewritten by the bias voltage $V_{x1}$ or $V_{x2}$, it is immediately rewritten to the gray-scale level signal $V_a$ to be written into the pixel concerned next; thereafter, the non-select level $V_{GL}$, which reduces the current $I_{DS}$ sufficiently small, is applied to the gate of the TFT until the instant preceding the application of the bias voltage $V_{x1}$ or $V_{x2}$. This indicates that it is possible to prevent the degradation of the charge retaining characteristic of the pixel mentioned as a shortcoming of the method proposed in literature 2 or Japanese Pat. Laid-Open No. 157815/90 referred to as the prior art.

E. When a voltage is applied across the capacitance $C_{LC}$ of the liquid crystal cell, the liquid crystal material assumes, for instance, a stand-up position with respect to the transparent base plate forming the liquid crystal panel. The liquid crystal material has dielectric anisotropy, and when the liquid crystal material stands up, its dielectric constant varies, causing a change in the value of the capacitance $C_{LC}$ accordingly. That is, the value of the capacitance $C_{LC}$ is expressed as a function of the voltage applied thereacross. As seen from Eq. (21'), a change in the source voltage $V_{Spp}$ causes a change in the drain voltage $V_{Dpp}$ as well and the voltage that is applied to the liquid crystal cell varies, causing a change in the value of the capacitance $C_{LC}$. When the capacitance $C_{LC}$ thus changes, the center potential $V_{do}$ of the amplitude of the drain voltage changes as seen from Eq. (19), causing a change in the optimum common potential to be provided from the outside. This means that since the gray-scale level signal differs with pixels when a certain display is provided on the liquid crystal display panel, the optimum common voltage to be applied to each pixel differs. Since it is impossible to apply the optimum common voltage to every pixel, it is customary in the art to apply a certain optimum common voltage uniformly all over the display screen instead. With this method, however, every pixel might be supplied with an optimum common voltage or not.

Accordingly, there is a DC voltage difference between the optimum common voltage and the common voltage actually applied to each pixel, and this DC voltage difference needs to be compensated for.

The simplest idea of compensating for this DC difference is "to shift the common voltage in a reverse direction by the same amount as that $dV_p$ by the voltage difference $V_g$" as proposed in the aforementioned prior art literature 2 . With this method, the drain voltage $V_D$ becomes equipotential with the source signal $V_S$ after time $t_1$ in FIG. 2, with the result that even if the source voltage $V_{Spp}$ varies, the center of the drain voltage $V_{Dpp}$ matches the center of the source signal $V_{Spp}$ and always remains constant. Hence, a constant common voltage $V_c$ is provided to match the center of the amplitude of the drain and source voltages $V_{Dpp}$ and $V_{Spp}$ which coincide with each other. In this case, even if the amplitude of the source voltage $V_{Spp}$ undergoes a change, application of an optimum common voltage can be attained.

A further discussion will be made of Eq. (19). Eq. (19) indicates that the average value $V_{do}$ of the drain potential can be set to an arbitrary value by freely changing the third term on the right-hand side. To solve the problems of flicker and image printing in the AMLCD, it is preferable to compensate for the abovementioned DC voltage difference which is caused by the dielectric anisotropy of the liquid crystal material (and a parasitic capacitance in the AMLCD).

Referring to Eq. (19), by applying an appropriate voltage $(V_{x1}+v_{x2})/2$ to adjust the center $V_{do}$ of the drain potential, it is possible to compensate for the DC voltage which is attributable to the dielectric anisotropy and the parasitic capacitance in the AMLCD. That is, by providing the common voltage $V_c$ equipotential with the center of the source signal $V_{Spp}$ and by adjusting the voltage $(V_{x1}+V_{x2})/2$ so that the center of the drain voltage $V_{Dpp}$ is equal to the center $V_{do}$ of the drain potential, the common voltage that can be said to be optimum to any pixels can be set as mentioned above, while at the same time the compensation of the DC voltage can be achieved. For such a reason, substituting the following equation for $V_{do}$ in Eq. (19):

$$V_{do}=(V_{S+}+V_{S-})/2 \tag{28}$$

we have $$-(C_{gd}/C_S)(V_{GH}-V_{GL})=V_{GL}-(V_{x1}+V_{x2})/2 \tag{29}$$

Eq. (29) does not contain the capacitance $C_{LC}$ as a parameter. Hence, even if the capacitance $C_{LC}$ undergoes a change as the result of a change in the dielectric constant of the liquid crystal material which is caused by its dielectric anisotropy or a temperature change, as long as the voltage $V_{GL}-(V_{x1}+V_{x2})/2$ is set to be equal to $(C_{gd}/C_S)(V_{GH}-V_{GL})$, the above-said equation $V_{do}=(V_{S+}+V_{S-})/2$ holds and $V_{do}$ remains unchanged. The tenth aspect of the present invention features the setting of $V_{do}$ to the center of $(V_{S+}+V_{S-})/2\cong V_{Spp}$.

The relationship between the voltage $V_{GL}$ and the bias voltages $V_{x1}$ and $V_{x2}$ at this time will be discussed with reference to FIG. 6B. FIG. 6B is a graph showing the applied voltage vs. transmittivity characteristic of liquid crystal in the case where the potential of the opposed electrode (the common electrode), that is, the common voltage $V_c$ is zero volt. In the driving method according to the tenth aspect of the invention, since the center of the amplitude of the source voltage, the center of the amplitude of the drain voltage and the potential of the opposed electrodes are equal, the zero volt in FIG. 6B is the center of the amplitude of the source voltage. Since the gray-scale level signal is 3.5 V, $V_{S+}$ is −1.75 V and $V_{S-}$ 1.75 V. Therefore, $\Delta V_C''=3.75$ V.

In Eq. (10), $V_{GH}-V_{GL}$, $C_{gd}$, $C_{LC}$ and $C_S$ take various values according to the liquid crystal display used. Hence, the first term on the tight-hand side of Eq. (10) may sometimes become greater than 3.75 V. In this instance, the second term on the right-hand side becomes negative or minus (the third aspect). That is, in the case of $[C_{gd}/(C_{gd}+C_{LC}+C_S)](V_{GH}-V_{GL})<3.75$, $V_{x1}>V_{GL}$ holds (the second aspect), and in the case of $[C_{gd}/(C_{gd}+C_{LC}+C_S)](V_{GH}-V_{GL})\geqq 3.75$, $V_{x1}\leqq V_{GL}$ holds (the third aspect).

In either case, it is evident from Eq. (15) that $V_{x2}<V_{GL}$.

The above holds true in the case where the common potential is set to a value near the center of the amplitude of the source voltage as well as in the case where the center of the amplitude of the source voltage and the common potential have the same value.

F. Next, a description will be given of the timing for supplying the bias voltages $V_{x1}$ and $V_{x2}$.

Figure 8A:
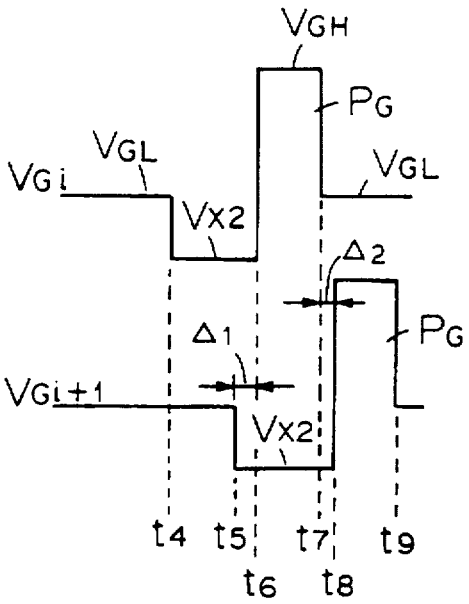
FIG. 8A is a waveform diagram showing the time relationship between the gate pulse $P_G$ of the gate voltage $V_{Gi}$ and the second bias voltage $V_{x2}$ of the gate voltage $V_{Gi+1}$ in FIG. 1A, with $\Delta_1>0$ and $\Delta_2>0$.

FIG. 8A is a waveform diagram showing only the gate signal waveforms $V_{Gi}$ and $V_{Gi+1}$ in FIG. 2. In the period from time $t_4$ through $t_9$, the period over which to apply the second bias voltage $V_{x2}$ to the electrode opposite the signal storage capacitor $C_S$ provided in the pixel on the (i+1)th row is from time $t_5$ through $t_8$, and the period over which to apply the select level to select the pixel of the i-th row is from time $t_6$ to $t_7$. That is, in FIG. 8A, the second bias voltage $V_{x2}$ is applied to the pixel of the (i+1)th row earlier by a time $t_6-t_5=\Delta_1$ than the voltage $V_{Gi}$ reaches the select level, and the second bias voltage is still held for a time $t_8-t_7=\Delta_2$ after the voltage $V_{Gi}$ went down to the non-select level. But FIG. 8A shows merely an example of the idea of the invention and the idea can be further expanded as described below.

Figure 8B:
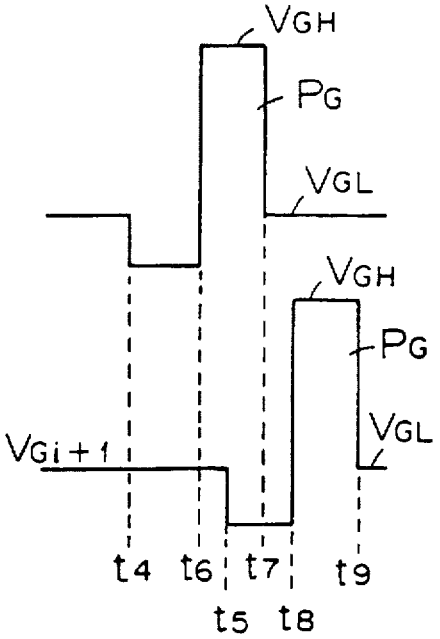
FIG. 8B is a waveform diagram when $\Delta_1=t_6-t_5<0$.

That is, even if it happens that the time $t_5$ at which the gate voltage $V_{Gi+1}$ reaches the bias voltage $V_{x2}$ satisfies $\Delta_1=t_6-t_5<0$ as shown in FIG. 8B, it is evident that no problem would arise if the TFT in the ON state for the period from time $t_5$ through $t_7$ is sufficiently capable of charging the capacitors $C_{gd}$, $C_{LC}$ and $C_S$ up to the source signal potential $V_s$. Hence, the time $\Delta_1=t_6-t_5$ is effective in the present invention through the vicinity of $\Delta_1=t_6-t_5=0$ on the plus or minus side thereof.

Figure 8C:
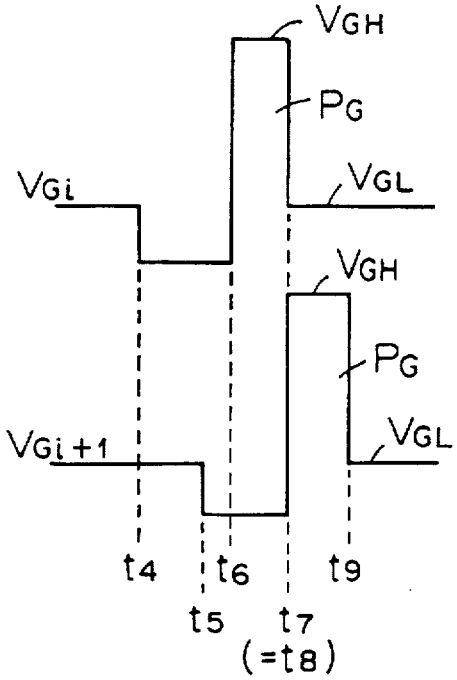
FIG. 8C is a waveform diagram when $t_7=t_8$ ($\Delta_2=0$).

FIG. 8C is a waveform diagram on the assumption that $t_7=t_8$ in FIG. 8A. In FIG. 8C, the time $t_7$ at which $V_{Gi}$ on the gate bus of the i-th row starts to change from the select level $V_{GH}$ to the non-select level $V_{GL}$ coincides with the time $t_8$ at which $V_{Gi+1}$ on the gate bus of the (i+1)th row starts to change from the level of the bias voltage $V_{x2}$ to the select level $V_{GH}$.

Figure 8D:
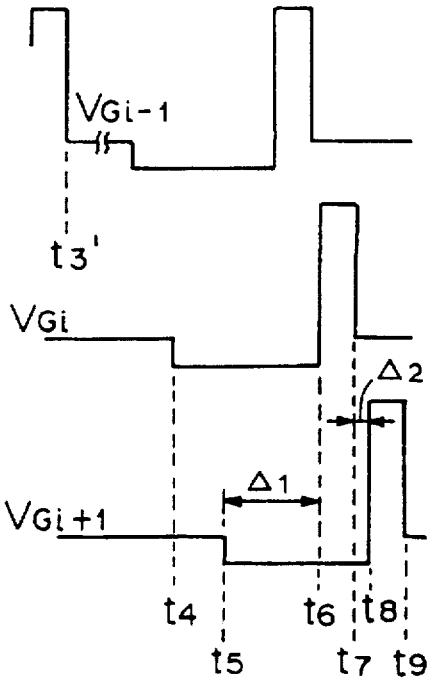
FIG. 8D is a waveform diagram when $\Delta_1$ extends over a plurality of rows.

Furthermore, even if the time $\Delta_1$ is so long that it extends over gate pulses $P_G$ of a plurality of preceding rows as depicted in FIG. 8D, no problem arises when it is sufficiently shorter than the time $t_4-t_3$ (usually shorter than the one-frame period).

In the above, the period over which the bias voltage $V_{x2}$ is provided; the same is true of the period over which the bias voltage $V_{x1}$ is provided.

On the other hand, as disclosed in "TFT-LCD Optical Characteristics Simulations,"Transaction of the Institute of Electronics, Information and Communication Engineers of Japan, [Electronic Display] EID91-45, pp. 41–45, it is known that image signals are distorted during the transition from the select level to the non-select level. This is because of a time difference $t_{OFF}$ between the start of transition from the select level to the non-select level and the time when the TFT actually exerts a sufficient OFF characteristic. In such a case, under the condition $t_7=t_8$ according to the present invention, the gate pulse $P_G$ is applied to the (i+1)th row when the TFT of the i-th row is turned OFF; hence, there is a fear that the bias of the (i+1)th row differs from the bias to be applied thereto, resulting in an error being induced.

However, such a bias error is mostly negligible in the case where (a) the output resistance of the gate driver and the time constant of the gate bus are relatively small and the aforementioned time difference $t_{OFF}$ is very small and (b) the on-state resistance of the TFT is relatively large and leakages from the capacitors $C_{gd}$, $C_{LC}$ and $C_S$ during the period $t_{OFF}$ are negligible. Therefore, when these conditions (a) and (b) are satisfied, $\Delta_2=0$, that is, $t_7=t_8$ is not against the principles of the present invention.

Figure 9:
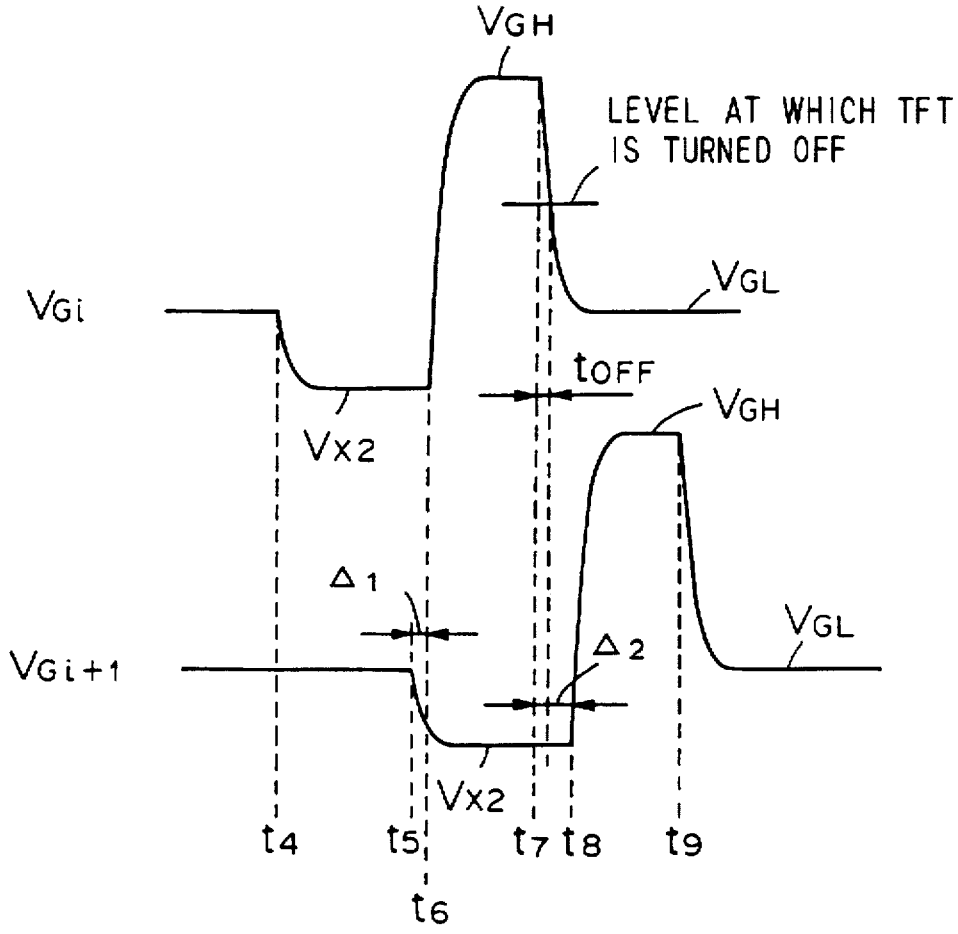
FIG. 9 is a waveform diagram when rise and fall times are present at leading and trailing edges of the gate pulse and the second bias voltage, respectively, in FIG. 8A.

Usually, $\Delta_2=t_8-t_7>0$ as shown in FIG. 8A but it may preferably be $\Delta_2=t_8-t_7>t_{OFF}$. This is shown in FIG. 9.

[With respect to the signal waveform of the gate bus of the last row]

The gate pulse $P_G$ can be omitted from the gate voltage $V_{Gm+1}$ of the gate bus of the last row; the gate voltages $V_{Gm+1}$ and $V_{Gm}$ and the drain voltage $V_D$ and source voltage $V_S$ of the TFT of the m-th row at that time are shown in FIG. 10. The operation at time $t<t_2$ in FIG. 10 is exactly the same as described previously with respect to FIG. 2, and hence no description will be repeated.

At $t=t_2$, the gate voltage $V_{Gm+1}$ drops to $V_{x1}$, and consequently, the drain potential of the TFT of the m-th row shifts downward in proportion to the potential applied from the $C_S$ side. The shift amount $dV_Q'$ in this case is given by the following equation (30):

$$dV_Q'=[C_S/(C_{gd}+C_{LC}+C_S)](V_{x1}-V_{GL}) \quad (30)$$

As a result, the total shift amount $\Delta V_C''$ during the period from $t=t_1$ through $t=t_2$ is expressed by the following equation:

$$\Delta V_C\Delta=dV_p+dV_Q'=-[C_{gd}/(C_{gd}+C_{LC}+C_S)](V_{GH}-V_{GL})+[C_S/(C_{gd}+C_{LC}+C_S)](V_{x1}-V_{GL}) \quad (31)$$

This is the same as Eq. (10).

Similarly, the operation during the period $t_4<t<t_8$ is also exactly the same as described previously in respect of FIG. 2, and hence no description will be repeated.

At $t=t_8$, since the gate voltage $V_{Gm+1}$ rises by $V_{x2}$, the drain potential of the m-th row shifts upward in proportion to the potential applied from the $C_S$ side. The shift amount $dV_R'$ is given by the following equation (32).

$$dV_R'=[C_S/(C_{gd}+C_{LC}+C_S)](V_{GL}-V_{x2}) \quad (32)$$

In consequence, the total shift amount $\Delta V_C'$ during the time interval from $t=t_7$ to $t=t_8$ is given as follows:

$$\begin{aligned}\Delta V_C' &= -dV_P+dV_R' \quad (33)\\ &= -[C_{gd}/(C_{gd}+C_{LC}+C_S)](V_{GH}-V_{GL})+\\ &\quad [C_S/(C_{gd}+C_{LC}+C_S)](V_{GL}-V_{x2})\end{aligned}$$

This is exactly the same as Eq. (15). Thus, the absence of the gate pulse $P_G$ in the gate voltage $V_{Gm+1}$ does not ever lessen the effect of the present invention for the reasons given below (the fourth aspect of the present invention).

(a) No TFT to be written is present.

(b) The shift amounts $V_C''$ and $V_C'$ of the drain potential on the m-th row are expressed by exactly the same equations as those of the shift amounts of the drain potential on the i-th row ($1 \leqq i \leqq m-1$).

As described above, (1) according to the present invention, the bias voltage is added to the non-select level $V_{GL}$ of the gate voltage $V_G$ at a time instant earlier than the rise of the gate pulse $P_G$. From time $t_1$ when the gate pulse $P_G$ dropped to the non-select level $V_{GL}$ to time $t_4$ when the bias voltage is provided in the next frame, the gate voltage is held at the non-select level which sufficiently reduces the source-drain current $I_{DS}$. Thus, the present invention is free from the problem of the prior art that data once written in the TFT is partly rewritten by a leakage current flowing therein owing to the bias voltage which is applied after time $t_1$ when the write of the gray-scale level signal was completed; consequently, the charge retaining characteristic of the pixel can be improved.

(2) According to the present invention, by setting the peak-to-peak value $V_{Spp}$ of the output voltage from the source driver to be equal to the maximum amplitude $V_{amx}$ of the gray-scale level signal $V_a$ contained in the source driver output voltage, it is possible to minimize the source driver output voltage and, at the same time, implement reduction of the entire power consumption of the device.

(3) According to the present invention, by adjusting the average value, $(V_{x1}+V_{x2})/2$, of the first and second bias voltages to make the center value $V_{do}$ of the drain voltage $V_{Dpp}$ (the common voltage $V_c$ being selected to be equal to the value $V_{do}$) equal to the center value of the source voltage $V_S$, it is possible to compensate for the DC voltage which is caused by the dielectric anisotropy of liquid crystal and the parasitic capacitance in the AMLCD.

We claim:

1. A method for driving an active matrix liquid crystal display wherein pixels $L_{ij}$ defined by liquid crystal cells each formed by a display electrode and a common electrode separated by liquid crystal held therebetween are arranged in a matrix form; source buses $S_j$ arranged in columns, where j=1 to n, and gate buses $G_i$ arranged in rows, where i=1 to m+1, are provided corresponding to said matrix array of pixels; thin film transistors $Q_{ij}$ are formed, each having a source connected to one of said source buses near the intersection of said one source bus and one of said gate buses, a gate connected to said one gate bus and a drain connected to a corresponding one of said display electrodes; a signal storage capacitor is formed in each of said pixels $L_{ij}$, said signal storage capacitor having its one electrode connected to said corresponding display electrode and having the other electrode connected to said gate bus $G_{i+1}$; a DC voltage is applied as a common voltage $V_c$ to said common electrode; a gray-scale level signal $V_a$ is applied from a source driver to all of said source buses every horizontal scanning period H; and gate pulses $P_G$ of a high level $V_{GH}$ are each applied from a gate driver to said gate buses one after another every horizontal scanning period H to turn ON the thin film transistors connected to the gate buses during the period of the gate pulses $P_G$;

wherein:

(a) said gray-scale level signal $V_a$, which is applied to pixels on a selected one of said gate buses, is added, with its polarity inverted every predetermined alternating period, to first and second source bias voltages $V_{S+}$ and $V_{S-}$ which are generated alternately with said alternating period, whereby source voltages are obtained, said source voltages being outputted to said source buses;

(b) a gate voltage $V_G$ includes a period of said high-level gate pulse which holds said each thin film transistor in the ON state substantially during said horizontal scanning period H in each frame period, a gate bias period which immediately precedes the rise of each of said gate pulses and during which either one of first and second gate bias voltages $V_{x1}$ and $V_{x2}$ is assumed and a period of a predetermined low-level voltage $V_{GL}$ which holds said each thin film transistor in the OFF state during said frame period except said gate pulse period and said gate bias period, said gate voltage $V_G$ being applied to said gate buses so that said gate pulses are sequentially displaced said horizontal scanning period H apart, and said gate bias period of an i-th row has a wide span from the time of rise of said gate pulse on said i-th row to the time prior to the fall of said gate pulse on the immediately preceding (i-1)th row, whereby said first and second gate bias voltages $V_{x1}$ and $V_{x2}$, which are applied to said i-th row, are alternately added to said gate voltage $V_G$ in positive and negative write periods in AC-wise driving of the pixels on the (i-1)th row, respectively; and (c) said gate pulse $P_G$ is not added to a gate voltage $V_{Gm+1}$ of the last gate bus and this gate voltage is added with the first and second bias voltages $V_{x1}$ and $V_{x2}$ alternately and then goes to said low-level voltage $V_{GL}$.

2. The drive method of claim 1, wherein said first gate bias voltage $V_{x1}$ is set to $V_{x1}>V_{GL}$ with respect to said low level $V_{GL}$ and said second gate bias voltage $V_{x2}$ is set to $V_{x2}<V_{GL}$ with respect to said low level $V_{GL}$.

3. The drive method of claim 1, wherein said first gate bias voltage $V_{x1}$ is set to $V_{x1}\leqq V_{GL}$ with respect to said low level and said second gate bias voltage $V_{x2}$ is set to $V_{x2}\leqq V_{GL}$ with respect to said low level $V_{GL}$.

4. The drive method of any one of claims 1 through 3, wherein either one of said common voltage $V_C$ to be applied to said common electrode and an average value, $(V_{x1}+V_{x2})/2$, of said first and second gate bias voltages $V_{x1}$ and $V_{x2}$ is set to an arbitrary value and the other is set to a value that satisfies $V_C=V_{do}$ wherein $V_{do}$ represents a center value of the drain potential.

5. The drive method of any one of claims 1 through 3 wherein, the difference, $V_{x1}-V_{x2}$, between said first and second bias voltages $V_{x1}$ and $V_{x2}$ is adjusted holding their average value $(V_{x1}+V_{x2})/2$ constant, and the peak-to-peak value $V_{Dpp}$ of the drain voltage of said TFT is set to an arbitrary value, holding the peak-to-peak value $V_{Spp}$ of the output voltage of said source driver.

6. The drive method of any one of claims 1 through 3, wherein the peak-to-peak value $V_{Spp}$ of the output voltage of said source driver is adjusted and the peak-to-peak value $V_{Dpp}$ of the drain voltage of said TFT is set to an arbitrary value holding the difference, $V_{x1}-V_{x2}$, between said first and second gate bias voltages $V_{x1}$ and $V_{x2}$ constant.

7. The drive method of claim 5 wherein said peak-to-peak value $V_{Spp}$ of the output voltage of said source driver is set to be equal to the maximum amplitude $V_{amx}$ of said gray-scale level signal $V_a$ contained in the output from said source driver.

8. The drive method of claim 4, wherein said average value, $(V_{x1}+V_{x2})/2$, of said first and second gate bias voltages is adjusted to make the center value $V_{do}$ of said drain voltage $V_D$ equal to the center value of said source voltage $V_{Spp}$.

9. The drive method of claim 6, wherein said peak-to-peak value $V_{Spp}$ of the output voltage of said source driver is set to be equal to the maximum amplitude $V_{amx}$ of said gray-level signal $V_a$ contained in the output from said source driver.

10. The drive method of any one of claims 1 through 3, wherein said predetermined period has a cycle of one or more rows or said frame period.

11. The drive method of any one of claims 1 through 3, wherein said gate bias period of said i-th row is set to a value such that it covers said gate pulse period of the immediately preceding (i-1)th row.

12. An active matrix liquid crystal display comprising:

a display panel wherein pixels $L_{ij}$ defined by liquid crystal cells each formed by a display electrode and a common electrode separated by liquid crystal held therebetween are arranged in the form of a matrix with i rows and j columns; source buses $S_j$ arranged in columns, where j=1 to n, and gate buses $G_i$ arranged in rows, where i=1 to m+1, are provided corresponding to said matrix array of pixels; thin film transistors $Q_{ij}$ are formed, each having a source connected to one of said source buses near the intersection of said one source bus and one of said gate buses, a gate connected to said one gate bus and a drain connected to a corresponding one of said display electrodes; a signal storage capacitor is formed in each of said pixels $L_{ij}$, said signal storage capacitor having one electrode connected to said corresponding display electrode and having another electrode connected to said gate bus $G_{i+1}$;

source driver means whereby a gray-scale level signal $V_a$, which is applied to pixels on a selected one of said gate buses, is added, with its polarity inverted every predetermined period, to first and second source bias voltages $V_{S+}$ and $V_{S-}$ which are generated alternately with said predetermined period to obtain source voltages $V_S$ and said source voltages are simultaneously supplied to said source buses during each horizontal scanning period H;

high-level voltage source means for outputting a high level $V_{GH}$ which turns ON said thin film transistors;

gate bias voltage source means for outputting first and second gate bias voltages $V_{x1}$ and $V_{x2}$, said gate bias voltage source mans comprising: a first variable voltage source for outputting a first variable voltage source for outputting a first variable voltage as a voltage corresponding to the sum of said first and second gate bias voltages, and a second variable voltage source means for outputting a second variable voltage as a voltage corresponding to the difference between said first and second gate bias voltages, adding-amplifting means for outputting the sum of said first and second variable voltages as said first gate bias voltages and substrating-amplifying means for outputting the difference between said first and second variable voltages as said second gate bias voltage;

low-level voltage source means for outputting a predetermined low level $V_{GL}$ which holds said thin film transistors in the OFF state; and gate bus drive means which selects said high-level voltage source means substantially during said horizontal scanning period H in each frame period and outputs said high level as a gate pulse, selects either one of said first and second gate bias voltages $V_{x1}$ and $V_{x2}$ immediately prior to the rise of said gate pulse in correspondence with a negative and a positive write period in AC-driving of pixels on an (i-1)th row and outputs said selected one of said first and second gate bias voltages, selects and outputs said low-level voltage $V_{GL}$ in said each frame period except the period of said gate pulse and said gate bias period, and applies said gate pulse to each of said gate buses so that said gate pulse is displaced said horizontal scanning period H apart from said gate pulse applied to adjacent ones of said gate buses, said gate bias period of an i-th row having a wide span from the time of rise of said gate pulse on said i-th row to the time prior to the fall of said gate pulse on the immediately preceding (i-1)th row.

13. A method for driving an active matrix liquid crystal display wherein pixels $L_{ij}$ defined by liquid crystal cells each formed by a display electrode and a common electrode separated by liquid crystal held therebetween are arranged in a matrix form; source buses $S_j$ arranged in columns, where j=1 to n, and gate buses $G_i$ arranged in rows, where i=1 to m+1, are provided corresponding to said matrix array of pixels; thing film transistors $Q_{ij}$ are formed, each having a source connected to one of said source buses near the intersection of said one source bus and one of said gate buses, a gate connected to said one gate bus and a drain connected to a corresponding one of said display electrodes; a signal storage capacitor is formed in each of said pixels $L_{ij}$ said signal storage capacitor having its one electrode connected to said corresponding display electrode and having the other electrode connected to said gate bus $G_{i+1}$; a DC voltage is applied as a common voltage $V_C$ to said common electrode; a gray-scale level signal $V_a$ is applied from a source driver to all of said source buses every horizontal scanning period H; and gate pulses $P_G$ of a high level $V_{GH}$ are each applied from a gate driver to said gate buses one after another every horizontal scanning period H to turn ON the thin film transistors connected to the gate buses during the period of the gate pulses $P_G$, wherein:

(a) said gray-scale level signal $V_a$, which is applied to pixels on a selected on of said gate buses, is added, with its polarity inverted every predetermined alternating period, to first and second source bias voltages $V_{S+}$ and $V_{S-}$ which are generated alternately with said alternating period, whereby source voltages are obtained, said source voltages being outputted to said source buses;

(b) an output voltage $k_1(V_{x1}+V_{x2})$ of a first variable DC supply, where $k_1$ is an arbitrary constant, and an output voltage $k_2(V_{x1}-V_{x2})$ of a second variable DC supply, where $k_2$ is an arbitrary constant, are calculated to obtain first and second gate bias voltages $V_{x1}$ and $V_{x2}$; and (c) a gate voltage $V_G$ includes a period of said high-level gate pulse which holds said each thin film transistor in the ON state substantially during said horizontal scanning period H in each frame period, a gate bias period which immediately precedes the rise of each of said gate pulses and during which either one of said first and second gate bias voltages $V_{x1}$ and $V_{x2}$ is assumed and a period of a predetermined low-level voltage $V_{GL}$ which holds said each thin film transistor in the OFF state during said frame period except said gate pulse period and said gate bias period, said gate voltage $V_G$ being applied to said gate buses so that said gate pulses are sequentially displaced said horizontal scanning period H apart, and said gate bias period of an i-th row has a wide span from the time of rise of said gate pulse on said i-th row to the time prior to the fall of said gate pulse on the immediately preceding (i-1)th row, whereby said first and second gate bias voltages $V_{x1}$ and $V_{x2}$, which are applied to said i-th row, are alternately added to said gate voltage $V_G$ in positive and negative write periods in AC-wise driving of the pixels on the (i-1)th row, respectively.

* * * * *